US007604043B2

(12) United States Patent
Higashida et al.

(10) Patent No.: US 7,604,043 B2
(45) Date of Patent: Oct. 20, 2009

(54) AIR CONDITIONER

(75) Inventors: Masahito Higashida, Sakai (JP); Takahiro Yamasaki, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 216 days.

(21) Appl. No.: 11/662,659

(22) PCT Filed: Sep. 9, 2005

(86) PCT No.: PCT/JP2005/016605

§ 371 (c)(1),
(2), (4) Date: Mar. 13, 2007

(87) PCT Pub. No.: WO2006/035586

PCT Pub. Date: Apr. 6, 2006

(65) Prior Publication Data

US 2007/0256816 A1 Nov. 8, 2007

(30) Foreign Application Priority Data

Sep. 28, 2004 (JP) ..... 2004-282115
May 12, 2005 (JP) ..... 2005-139411

(51) Int. Cl.
*F24H 3/06* (2006.01)

(52) U.S. Cl. ..... 165/122; 62/263; 415/207

(58) Field of Classification Search ..... 165/122; 62/263; 454/233, 234, 236; 415/204, 206, 415/207

See application file for complete search history.

(56) References Cited

U.S. PATENT DOCUMENTS 2,250,978 A * 7/1941 Weiland et al. ..... 62/280
2,322,357 A * 6/1943 Hagen ..... 415/204
2,387,348 A * 10/1945 Place ..... 415/131
3,374,831 A * 3/1968 Sieverding ..... 165/122
3,524,328 A * 8/1970 Schuster ..... 165/122
4,189,281 A * 2/1980 Katagiri et al. ..... 165/122
4,840,221 A * 6/1989 Dumas et al. ..... 165/41

FOREIGN PATENT DOCUMENTS

JP 03-18415 U 2/1991
JP 05-099444 A 4/1993
JP 2002-106945 A 4/2002

* cited by examiner

*Primary Examiner*—Teresa J Walberg
(74) *Attorney, Agent, or Firm*—Global IP Counselors

(57) ABSTRACT

An air conditioner includes a unit casing, an impeller, a scroll casing, and a heat exchanger. The unit casing is partitioned by a partition member into a fan chamber and a heat exchanger chamber. The heat exchanger is disposed inside the heat exchanger chamber so as to face a scroll blowout opening in the scroll casing. The scroll casing is disposed inside the fan chamber. A wall section projects from a heat exchanger side of a flat plate section of the partition member and is disposed outside a scroll outlet section of the scroll casing.

20 Claims, 17 Drawing Sheets

AIR CONDITIONER

CROSS-REFERENCE TO RELATED APPLICATIONS

This U.S. National stage application claims priority under 35 U.S.C. §119(a) to Japanese Patent Application Nos. 2004-282115, filed in Japan on Sep. 28, 2004, and 2005-139411, filed in Japan on May 12, 2005, the entire contents of which are hereby incorporated herein by reference.

TECHNICAL FIELD

The present invention relates to an air conditioner, and particularly to an air conditioner disposed with a unit casing partitioned by a partition member into a fan chamber and a heat exchanger chamber, with a centrifugal fan that includes an impeller and a scroll casing housing the impeller being disposed inside the fan chamber and a heat exchanger being disposed inside the heat exchanger chamber so as to face a scroll blowout opening in the scroll casing.

BACKGROUND ART

Conventionally, there has been an air conditioner disposed with a unit casing where a centrifugal fan that includes impellers and scroll casings housing the impellers and a heat exchanger are partitioned by a partition member into a heat exchanger chamber and a fan chamber, with the centrifugal fan that includes the impellers and the scroll casings housing the impellers being disposed inside the fan chamber and the heat exchanger being disposed inside the heat exchanger chamber so as to face scroll blowout openings in the scroll casings.

As one example of such an air conditioner, there is a ceiling-hung type air conditioner. A ceiling-hung type air conditioner is mainly disposed with a unit casing capable of being hung from a ceiling, a centrifugal fan that sucks air into the unit casing via a unit suction opening and blows out air from a unit blowout opening, and a heat exchanger.

The unit suction opening is formed in the bottom surface of the unit casing, and the unit blowout opening is formed in the front surface of the unit casing. Further, a partition member comprising a plate-like member that is long from side to side and disposed upright is disposed in the unit casing to partition the space inside the unit casing into a fan chamber at the rear surface side that is communicated with the unit suction opening and a heat exchanger chamber at the front surface side that is communicated with the unit blowout opening. More specifically, the partition member includes a flat plate section that runs parallel to the front surface and the rear surface of the unit casing (i.e., orthogonal to the side surfaces of the unit casing). Communication openings that allow the fan chamber and the heat exchanger chamber to be communicated are formed in the flat plate section.

The centrifugal fan is disposed inside the fan chamber and mainly includes impellers, scroll casings housing the impellers, and a motor that drives the impellers to rotate. The impellers are, for example, double suction type sirocco fan rotors whose rotational axis is disposed facing the sides of the unit casing. The scroll casings include scroll body sections, which include scroll suction openings that open in the direction of the rotational axis of the impellers, and cylindrical scroll outlet sections, which include scroll blowout openings formed so as to blow out air in a direction intersecting the scroll suction openings and disposed so as to correspond to the communication openings in the partition member. In such an air conditioner, oftentimes the impellers and the scroll casings are disposed plurally juxtaposed in the rotational axis direction—that is, facing the sides of the unit casing—and in this case, the plural impellers are collectively driven to rotate by a single motor.

The heat exchanger is disposed inside the heat exchanger chamber so as to face the scroll blowout openings—and more specifically, so as to face substantially the entire flat plate section of the partition member—and is a device for cooling and heating air whose pressure has been boosted by the centrifugal fan inside the fan chamber and which has been blown out into the heat exchanger chamber from the scroll blowout openings in the scroll casings.

In such an air conditioner, when the centrifugal fan is actuated, air is sucked into the fan chamber of the unit casing via the unit suction opening, and the air that has been sucked into the fan chamber is sucked into the scroll casings through the scroll suction openings and is blown out from the inner peripheral sides to the outer peripheral sides of the impellers. The air that has been blown out to the outer peripheral sides of the impellers and whose pressure has been boosted is blown out into the heat exchanger chamber from the scroll blowout openings disposed so as to correspond to the communication openings in the partition member. Then, the air that has been blown out into the heat exchanger chamber from the scroll blowout openings is cooled or heated as a result of heat exchange being performed with refrigerant flowing inside a heat transfer tube of the heat exchanger and is blown out into the room from the unit blowout opening (e.g., see Japanese Patent JP-A No. 2002-106945).

However, in the above-described conventional air conditioner, whereas the heat exchanger faces substantially the entire flat plate section of the partition member, the communication openings in the flat plate section—that is, the scroll blowout openings in the scroll casings—are only disposed partially in the flat plate section of the partition member, so problems occur in which the air blown out into the heat exchanger chamber from the scroll blowout openings passes through the heat exchanger without being diffused, nonuniformity in the flow of air passing through the heat exchanger occurs, ventilation resistance in the heat exchanger increases, and blowing capability and heat exchange capability are reduced. Particularly in the case of a configuration where impellers and scroll casings are disposed plurally juxtaposed as in the above-described conventional air conditioner, this problem occurs in each scroll blowout opening.

With respect to this, an air conditioner disposed with scroll casings where the size of the scroll outlet sections in the direction of the rotational axis of the impellers is enlarged has been proposed (see Japanese Patent JP-A No. 5-99444).

SUMMARY OF THE INVENTION

In the above-described latter air conditioner, the problem of nonuniformity in the flow of air passing through the heat exchanger is reduced because the size of the scroll blowout openings is enlarged, but because the size of the scroll outlet sections is much larger than the size of the impellers, this hinders the scroll suction openings such that dynamic pressure recovery in the scroll outlet sections becomes difficult and, as a result, there is the potential for this to cause the blowing capability to be reduced.

Further, when there is enough space inside the fan chamber to be able to enlarge the size of the scroll outlet sections, it suffices to enlarge the sizes of the impellers and the scroll casings themselves, so it is difficult to apply the configuration of the above-described latter air conditioner when there is no extra space inside the fan chamber or when the unit casing must be made compact.

It is an object of the present invention to control nonuniformity in the flow of air passing through a heat exchanger while controlling a reduction in blowing capability in an air conditioner disposed with a unit casing partitioned by a partition member into a fan chamber and a heat exchanger chamber, with a centrifugal fan that includes an impeller and a scroll casing housing the impeller being disposed inside the fan chamber and a heat exchanger being disposed inside the heat exchanger chamber so as to face a scroll blowout opening in the scroll casing.

An air conditioner pertaining to a first aspect of the present invention is disposed with a unit casing, a partition member, an impeller, a scroll casing, and a heat exchanger. The unit casing includes a unit suction opening and a unit blowout opening. The partition member partitions the space inside the unit casing into a fan chamber communicated with the unit suction opening and a heat exchanger chamber communicated with the unit blowout opening and includes a flat plate section in which a communication opening that allow the fan chamber and the heat exchanger chamber to be communicated is formed. The impeller is disposed in the fan chamber. The scroll casing includes a scroll body section that includes a scroll suction opening and house the impeller and a cylindrical scroll outlet section that includes a scroll blowout opening disposed in correspondence to the communication opening. The heat exchanger is disposed inside the heat exchanger chamber so as to face the scroll blowout opening such that air that has been blown out into the heat exchanger chamber from the scroll blowout opening is blown out from the unit blowout opening after passing through the heat exchanger. A wall section that projects from the heat exchanger side of the flat plate section is disposed outside the scroll outlet section.

In this air conditioner, the wall section that projects from the heat exchanger side of the flat plate section is disposed outside the scroll outlet section, so that inside the heat exchanger chamber, a portion whose pressure is lower (called a negative pressure portion below) than the pressure of the air that has been blown out into the heat exchanger chamber from the scroll blowout opening is formed in the outside vicinity of the scroll blowout opening. Additionally, the air blown out into the heat exchanger chamber from the scroll blowout opening flows so as to be pulled into the negative pressure portion, so that the air is diffused to the outside of the scroll blowout opening. Thus, nonuniformity in the flow of air passing through the heat exchanger can be controlled while controlling a reduction in blowing capability.

An air conditioner pertaining to a second aspect of the present invention comprises the air conditioner pertaining to the first aspect of the present invention, wherein a distance between the portion where the scroll outlet section and the surface of the flat plate section on the heat exchanger side intersect and the portion where the wall section and the surface of the flat plate section on the heat exchanger side intersect is equal to or less than 0.5 times a rotor width of the impeller.

In this air conditioner, the distance between the portion where the scroll outlet section and the surface of the flat plate section on the heat exchanger side intersect and the portion where the wall section and the surface of the flat plate section on the heat exchanger side intersect is made equal to or less than 0.5 times a rotor width of the impeller, so that the negative pressure portion can be reliably formed in the outside vicinity of the scroll blowout opening.

An air conditioner pertaining to a third aspect of the present invention comprises the air conditioner pertaining to the first or second aspect of the present invention, wherein a distance from the surface of the flat plate section on the heat exchanger side to an end portion of the scroll outlet section on the heat exchanger side is greater than 0 and equal to or less than 0.3 times a rotor diameter of the impeller.

In this air conditioner, by making the distance from the surface of the flat plate section on the heat exchanger side to the end portion of the scroll outlet section on the heat exchanger side greater than 0—that is, by allowing the end portion of the scroll outlet section on the heat exchanger side to project toward the heat exchanger chamber—the negative pressure portion comprising a space interposed between the wall section and the end portion of the scroll outlet section on the heat exchanger side can be formed in the outside vicinity of the scroll blowout opening where the effect of causing the air blown out into the heat exchanger chamber from the scroll blowout opening to be diffused outside the scroll blowout opening is large. Moreover, by making the distance from the surface of the flat plate section on the heat exchanger side to the end portion of the scroll outlet section on the heat exchanger side equal to or less than 0.3 times the rotor diameter of the impeller, a distance that is sufficient for the air blown out into the heat exchanger chamber from the scroll blowout opening to diffuse outside the scroll blowout opening can be ensured between the scroll blowout opening and the heat exchanger.

An air conditioner pertaining to a fourth aspect of the present invention comprises the air conditioner pertaining to the third aspect of the present invention, wherein a distance from the surface of the flat plate section on the heat exchanger side to an end portion of the wall section on the heat exchanger side is equal to or greater than the distance from the surface of the flat plate section on the heat exchanger side to the end portion of the scroll outlet section on the heat exchanger side and is equal to or less than 0.5 times the rotor diameter of the impeller.

In this air conditioner, by making the distance from the surface of the flat plate section on the heat exchanger side to the end portion of the wall section on the heat exchanger side equal to or greater than the distance from the surface of the flat plate section on the heat exchanger side to the end portion of the scroll outlet section on the heat exchanger side—that is, by allowing the end portion of the wall section to project further toward the heat exchanger than the end portion of the scroll outlet section on the heat exchanger side—the difference in pressure between the pressure of the negative pressure portion comprising a space interposed between the wall section and the end portion of the scroll outlet section on the heat exchanger side and the pressure of the air blown out into the heat exchanger chamber from the scroll blowout opening can be made greater, so that the effect of causing the air blown out into the heat exchanger chamber from the scroll blowout opening to be diffused outside the scroll blowout opening can be raised. Moreover, by making the distance from the surface of the flat plate section on the heat exchanger side to the end portion of the wall section on the heat exchanger side equal to or less than 0.5 times the rotor diameter of the impeller, it can be ensured that the flow of air to be diffused by the negative pressure portion to the outside of the scroll blowout opening is, as much as possible, not restricted by the wall section, so that the air blown out into the heat exchanger chamber from the scroll blowout opening can be further diffused outside the wall section.

An air conditioner pertaining to a fifth aspect of the present invention comprises the air conditioner of any of the first to fourth aspects of the present inventions, wherein an angle formed by the wall section and the surface of the flat plate section on the heat exchanger side is greater than 30° and equal to or less than 90°.

In this air conditioner, by making the angle formed by the wall section and the surface of the flat plate section on the heat exchanger side greater than 30°, the negative pressure portion can be reliably formed in the outside vicinity of the scroll blowout opening. Moreover, by making the angle formed by the wall section and the surface of the flat plate section on the heat exchanger side equal to or less than 90°, it can be ensured that the air blown out into the heat exchanger chamber from the scroll blowout opening is reliably diffused to the outside of the scroll blowout opening.

An air conditioner pertaining to a sixth aspect of the present invention comprises the air conditioner of any of the first to fifth aspects of the present inventions, wherein serrations are disposed in the end portion of the wall section on the heat exchanger side.

In this air conditioner, serrations are disposed in the end portion of the wall section on the heat exchanger side, so that variations in the pressure of the air blown out into the heat exchanger chamber from the scroll blowout opening at the end portion of the wall section on the heat exchanger side can be controlled. Thus, the occurrence of noise resulting from pressure variations at the end portion of the wall section on the heat exchanger side can be controlled.

An air conditioner pertaining to a seventh aspect of the present invention comprises the air conditioner pertaining to any of the first to sixth aspects of the present inventions, wherein plural dimples are disposed in the surface of the wall section on the side of the scroll outlet section.

In this air conditioner, plural dimples are disposed in the surface of the wall section on side of the scroll outlet section, so that the air blown out into the heat exchanger chamber from the scroll blowout opening can be matched to the surface of the wall section on the side of scroll outlet section. Thus, the effect of causing the air blown out into the heat exchanger chamber from the scroll outlet section to be diffused to the outside of the scroll blowout opening can be raised.

An air conditioner pertaining to an eighth aspect of the present invention comprises the air conditioner pertaining to any of the first to sixth aspects of the present inventions, wherein plural through holes are disposed in the wall section.

In this air conditioner, plural through holes are disposed in the wall section, so that the air blown out into the heat exchanger chamber from the scroll blowout opening can be matched to the surface of the wall section on the scroll outlet section. Thus, the effect of causing the air blown out into the heat exchanger chamber from the scroll blowout opening to be diffused to the outside of the scroll blowout opening can be raised.

An air conditioner pertaining to a ninth aspect of the present invention comprises the air conditioner pertaining to any of the first to eighth aspects of the present inventions, wherein the impeller is disposed so as to rotate about a rotational axis along the flat plate section. The air conditioner further includes a motor that is disposed on the rotational axis direction side of the scroll casing inside the fan chamber and which drives the impeller to rotate. The scroll outlet section extends toward the communication opening while slanting toward the motor but without its size in the rotational axis direction being enlarged.

In an air conditioner disposed with a unit casing partitioned by a partition member into a fan chamber and a heat exchanger chamber, with a centrifugal fan that includes an impeller and a scroll casing housing the impeller being disposed inside the fan chamber and a heat exchanger being disposed inside the heat exchanger chamber so as to face a scroll blowout opening in the scroll casing, as in a conventional air conditioner, the impeller is disposed so as to rotate about a rotational axis along a flat plate section of the partition member, and the motor that drives the impeller to rotate is disposed on the rotational axis direction side of the scroll casing inside the fan chamber.

In an air conditioner having this configuration, the air that has been blown out into the heat exchanger chamber from the scroll blowout opening in the scroll casing mainly ends up passing through the portion of the heat exchanger facing the scroll casing with the flat plate section interposed therebetween and it becomes difficult for the air to pass through the portion of the heat exchanger facing the motor with the flat plate section interposed therebetween, so it becomes easy for problems to occur in which nonuniformity in the flow of air passing through the heat exchanger occurs, ventilation resistance in the heat exchanger increases, and blowing capability and heat exchange capability decrease.

With respect to this, in the air conditioner pertaining to the aspect of the present invention, the scroll outlet section extends toward the communication opening while slanting toward the motor but without its size in the rotational axis direction being enlarged, so it becomes easier for the air to also pass through the portion of the heat exchanger facing the motor with the flat plate section interposed therebetween, and nonuniformity in the flow of air passing through the heat exchanger can be controlled. Moreover, because it is ensured that the size of the scroll outlet section in the rotational axis direction is not enlarged, it also becomes difficult for drawbacks such as dynamic pressure recovery in the scroll outlet section becoming difficult to occur, and a reduction in blowing performance can be controlled.

An air conditioner pertaining to a tenth aspect of the present invention comprises the air conditioner pertaining to any of the first to eighth aspects of the present inventions, wherein the impeller is disposed so as to rotate about a rotational axis along the flat plate section. The wall section is disposed outside the scroll outlet section in the rotational axis direction.

In an air conditioner disposed with a unit casing partitioned by a partition member into a fan chamber and a heat exchanger chamber, with a centrifugal fan that includes an impeller and a scroll casing housing the impeller being disposed inside the fan chamber and a heat exchanger being disposed inside the heat exchanger chamber so as to face a scroll blowout opening in the scroll casing, when the impeller is disposed so as to rotate about a rotational axis along a flat plate section of the partition member, there is a strong tendency for it to be difficult for the air blown out to the heat exchanger chamber from the scroll outlet section opening in the direction intersecting the rotational axis to be diffused in the direction along the rotational axis.

However, in this air conditioner, the wall section is disposed outside in the rotational axis direction, so that inside the heat exchanger chamber, the negative pressure portion is formed in the outside vicinity of the scroll blowout opening in the rotational axis direction. Additionally, the air blown out into the heat exchanger chamber from the scroll blowout opening flows so as to be pulled into the negative pressure portion, so that it becomes easier for the air to be diffused to the outside of the scroll blowout opening in the rotational axis direction. Thus, nonuniformity in the flow of air passing through the heat exchanger can be controlled while controlling a reduction in blowing capability.

An air conditioner pertaining to an eleventh aspect of the present invention comprises the air conditioner pertaining to the tenth aspect of the present invention, wherein the impellers and the scroll casings are disposed plurally juxtaposed in the rotational axis direction. The wall sections are disposed on adjacent scroll casing sides of the outside of the scroll outlet sections.

In an air conditioner disposed with a unit casing partitioned by a partition member into a fan chamber and a heat exchanger chamber, with a centrifugal fan that includes impellers and scroll casings housing the impellers being disposed inside the fan chamber and a heat exchanger being disposed inside the heat exchanger chamber so as to face scroll blowout openings in the scroll casings, when the impellers are disposed so as to rotate about a rotational axis along a flat plate section of the partition member and the impellers and scroll casings are plurally juxtaposed in the rotational axis direction, a clearance is formed between adjacent scroll casings and it becomes difficult for the air that has been blown out into the heat exchanger chamber from the scroll outlet sections to pass through the portion corresponding to this clearance.

However, in this air conditioner, the wall sections are disposed on adjacent scroll casing sides of the outside of the scroll outlet sections, so that inside the heat exchanger chamber, the negative pressure portions are formed on adjacent scroll casings sides of the scroll blowout openings. Additionally, the air blown out into the heat exchanger chamber from the scroll blowout openings flows so as to be pulled into the negative pressure portions, so that it becomes easier for the air to be diffused to the adjacent scroll casing sides of the scroll blowout openings. Thus, nonuniformity in the flow of air passing through the heat exchanger can be controlled while controlling a reduction in blowing capability.

An air conditioner pertaining to a twelfth aspect of the present invention comprises the air conditioner pertaining to the tenth or eleventh aspect of the present invention, wherein the air conditioner further includes a motor that is disposed on the rotational axis direction side of the scroll casing inside the fan chamber and which drives the impeller to rotate. The wall section is disposed on the motor side of the outside of the scroll outlet section.

In an air conditioner disposed with a unit casing partitioned by a partition member into a fan chamber and a heat exchanger chamber, with a centrifugal fan that includes an impeller and a scroll casing housing the impeller being disposed inside the fan chamber and a heat exchanger being disposed inside the heat exchanger chamber so as to face a scroll blowout opening in the scroll casing, when the impeller is disposed so as to rotate about a rotational axis along a flat plate section of the partition member and the motor that drives the impeller to rotate is disposed on the rotational axis direction side of the scroll casing, the air that has been blown out into the heat exchanger chamber from the scroll blowout opening mainly ends up passing through the portion of the heat exchanger facing the scroll casing with the flat plate section interposed therebetween, and it becomes difficult for the air to pass through the portion of the heat exchanger facing the motor with the flat plate section interposed therebetween.

However, in this air conditioner, the wall section is disposed on the motor side of the outside of the scroll outlet section, so that inside the heat exchanger chamber, the negative pressure portion is formed on the motor side of the scroll blowout opening. Additionally, the air blown out into the heat exchanger chamber from the scroll blowout opening flows so as to be pulled into the negative pressure portion, so that it becomes easier for the air to be diffused to the motor side of the scroll blowout opening. Thus, nonuniformity in the flow of air passing through the heat exchanger can be controlled while controlling a reduction in blowing capability.

An air conditioner pertaining to a thirteenth aspect of the present invention comprises the air conditioner pertaining to the twelfth aspect of the present invention, wherein the scroll outlet section extends toward the communication opening while slanting toward the motor but without its size in the rotational axis direction being enlarged.

In this air conditioner, the scroll outlet section extends toward the communication opening while slanting toward the motor but without its size in the rotational axis direction being enlarged, so it becomes easier for the air to also pass through the portion of the heat exchanger facing the motor with the flat plate section interposed therebetween, and nonuniformity in the flow of air passing through the heat exchanger can be further controlled. Moreover, because it is ensured that the size of the scroll outlet section in the rotational axis direction is not enlarged, it also becomes difficult for drawbacks such as dynamic pressure recovery in the scroll outlet section becoming difficult to occur, and a reduction in blowing performance can be controlled.

DETAILED DESCRIPTION OF THE INVENTION

Embodiments of an air conditioner pertaining to the present invention will be described below on the basis of the drawings.

First Embodiment (1) Basic Structure of Air Conditioner

Figure 1:
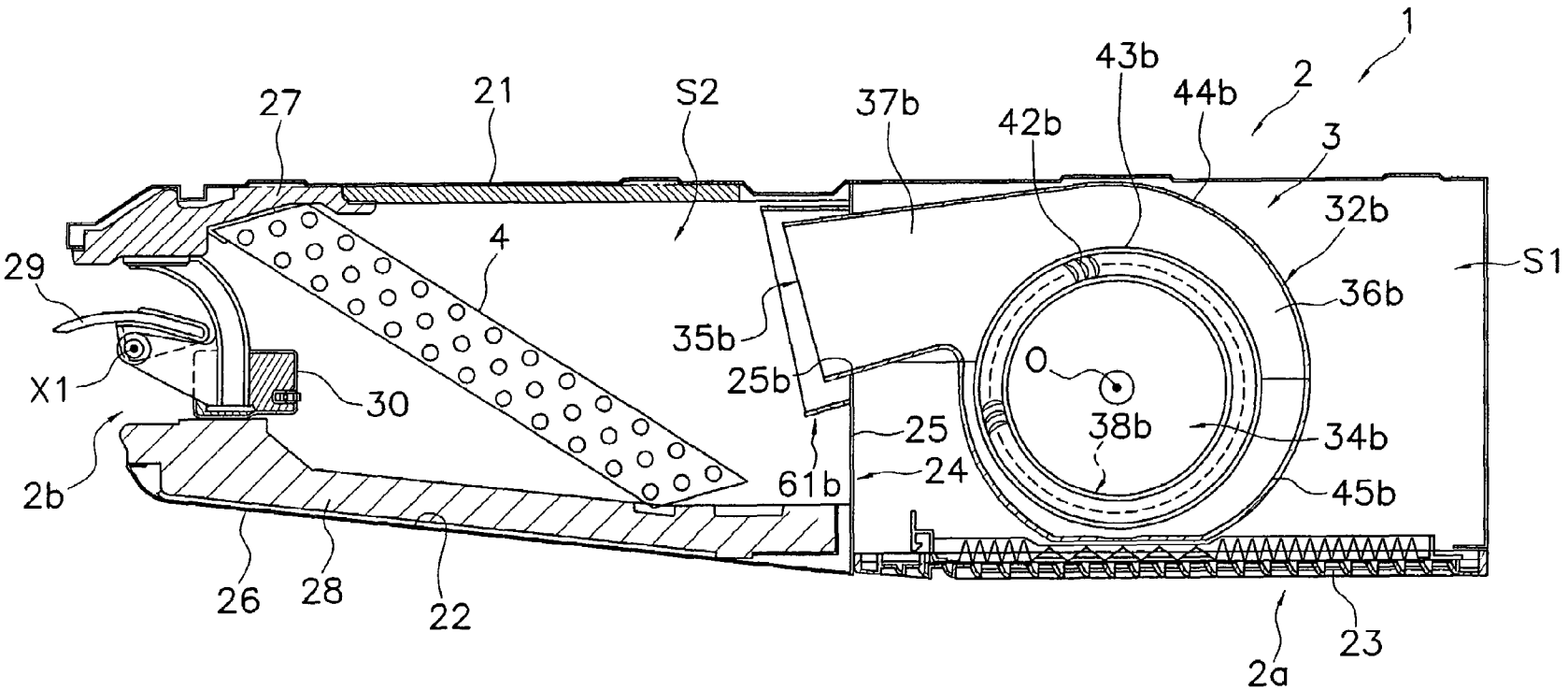
FIG. 1 is a side sectional view of a ceiling-hung type air conditioner serving as a first embodiment of an air conditioner pertaining to the present invention.
Figure 2:
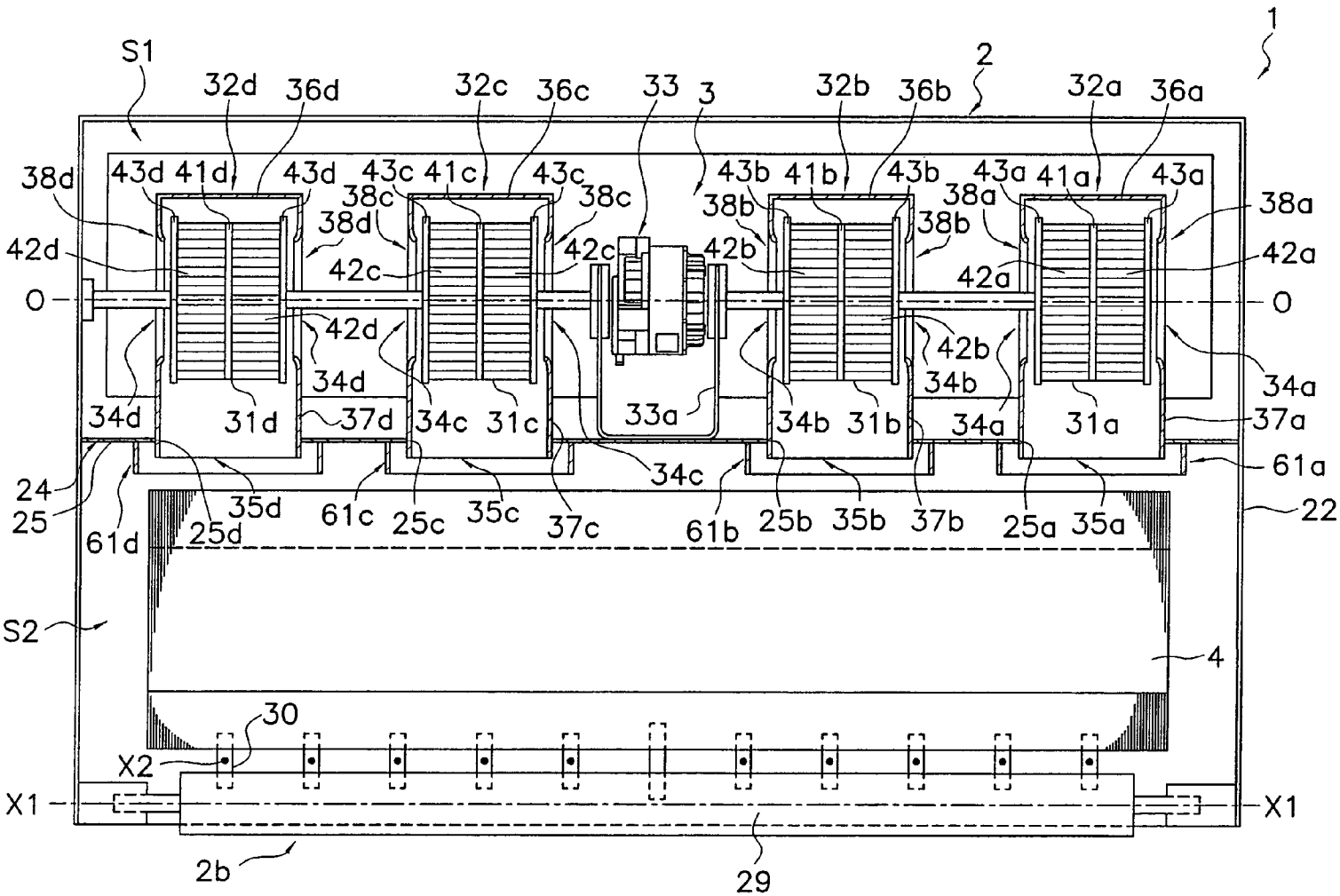
FIG. 2 is a plan sectional view of the ceiling-hung type air conditioner serving as the first embodiment of the air conditioner pertaining to the present invention.

FIG. 1 and FIG. 2 show a ceiling-hung type air conditioner 1 serving as a first embodiment of the air conditioner pertaining to the present invention. Here, FIG. 1 is a side sectional view (showing the cross section of a scroll casing 32*b*) of the air conditioner 1. FIG. 2 is a plan sectional view of the air conditioner 1.

The air conditioner 1 is disposed hanging from a ceiling in an air-conditioned room and is connected via refrigerant communication pipes (not shown) to an outdoor unit (not shown) disposed outdoors.

The air conditioner 1 is mainly disposed with a unit casing 2, a centrifugal fan 3, and a heat exchanger 4.

<Unit Casing>

The unit casing 2 is shaped like a thin box overall that is long from side to side and is formed such that its dimension in the height direction becomes smaller from the rear surface side to the front surface side. A unit suction opening 2*a* that sucks room air into the unit casing 2 is disposed in a portion at the rear surface side of the bottom surface of the unit casing 2. Further, a unit blowout opening 2*b* that blows cooled or heated air into the room from the inside of the unit casing 2 is disposed in the front surface of the unit casing 2.

More specifically, the unit casing 2 mainly includes a top plate section 21 capable of being hung from the ceiling, a bottom plate section 22 disposed facing the portion at the front surface side of the top plate section 21, and a suction grill 23 disposed facing the portion at the rear surface side of the top plate section 21. The top plate section 21 is a metal plate-like member formed as a result of its pair of side surfaces and its rear surface being folded by sheet metal processing. The suction grill 23 is detachably attached to the top plate section 21 and configures the suction opening 2*a*.

Further, a partition member 24 comprising a plate-like member that is long from side to side and disposed upright is disposed between the bottom plate section 22 and the suction grill 23 of the unit casing 2. The partition member 24 partitions the space inside the unit casing 2 into a fan chamber S1 at the rear surface side that is communicated with the unit suction opening 2*a* and a heat exchanger chamber S2 at the front surface side that is communicated with the unit blowout opening 2*b*. More specifically, in the present embodiment, the partition member 24 includes a flat plate section 25 that runs parallel to the front surface and the rear surface of the unit casing 2 (i.e., orthogonal to the side surfaces of the unit casing 2). Additionally, four communication openings 25*a* to 25*d* that correspond to scroll blowout openings 35*a* to 35*d* (described later) of four scroll casings 32*a* to 32*d* configuring the centrifugal fan 3 and allow the fan chamber S1 and the heat exchanger chamber S2 to be communicated are formed in the flat plate section 25. The four communication openings 25*a* to 25*d* are disposed juxtaposed in the longitudinal direction of the flat plate section 25 and, in the present embodiment, are rectangular holes.

The front surface, the side surfaces, and the bottom surface of the unit casing 2 are covered by an outer member 26 made of synthetic resin. A heat insulating member 27 comprising styrene foam, for example, is attached to the top plate section 21 in the vicinity of the unit blowout opening 2*b*. Further, a drain pan 28 comprising styrene foam, for example, is attached to the inside portion of the bottom plate section 22. The unit blowout opening 2*b* that is substantially rectangular and long from side to side is configured by the portions of the unit casing 2 at the front surface side including the portions of the outer member 26 and the heat insulating member 27 at the front surface side, and the portion of the drain pan 28 at the front surface side.

A first flap 29 that swings up and down and plural second flaps 30 that swing right and left are disposed in the unit blowout opening 2*b*. The first flap 29 comprises a plate-like member that is long from side to side, and is supported by the unit casing 2 so as to freely swing about a first axis X1 along the longitudinal direction of the unit blowout opening 2*b*. The plural second flaps 30 are supported by the unit casing 2 so as to freely swing about second axes X2 that cross the first axis X1 at positions on the rear surface side of the first axis X1.

<Centrifugal Fan>

The centrifugal fan 3 is disposed inside the fan chamber S1 and is a device for sucking air into the fan chamber S1 from the unit suction opening 2*a*, boosting the pressure of the air, and blowing out the air to the heat exchanger chamber S2 through the communication openings 25*a* to 25*d* in the partition member 24. Additionally, the centrifugal fan 3 mainly includes four impellers 31*a* to 31*d*, four scroll casings 32*a* to 32*d* housing the impellers 31*a* to 31*d*, and a motor 33 that drives the impellers 31*a* to 31*d* to rotate.

First, the impellers 31*a* to 31*d* will be described using FIG. 1 and FIG. 2. In the present embodiment, the impellers 31*a* to 31*d* are double suction type sirocco fan rotors and are disposed juxtaposed such that their rotational axis O faces the sides of the unit casing 2 (i.e., along the flat plate section 25 of the partition member 24). It will be noted that, because the impellers 31*a* to 31*d* all have the same structure, just the configuration of the impeller 31*b* will be described here, and in regard to the configurations of the impellers 31*a*, 31*c*, and 31*d*, the letters a, c, and d will be added instead of the letter b representing the respective parts of the impeller 31*b* and description of those respective parts will be omitted.

The impeller 31*b* mainly includes a discoid main plate 41*b* that rotates about the rotational axis O, numerous blades 42*b* that are disposed annularly around the rotational axis O on both sides of the outer peripheral portion of the main plate 41*b* with one end of each blade being fixed to the main plate 41*b*, and a pair of side plates 43*b* that are disposed on both rotational axis O direction sides of the main plate 41*b* and join together the other ends of the numerous blades 42*b*.

Next, the scroll casings 32*a* to 32*d* will be described. It will be noted that, because the scroll casings 32*a* to 32*d* all have the same structure, just the configuration of the scroll casing 32*b* will be described here, and in regard to the configurations of the scroll casings 32*a*, 32*c*, and 32*d*, the letters a, c, and d will be added instead of the letter b representing the respective parts of the scroll casing 32*b* and description of those respective parts will be omitted.

The scroll casing 32*b* includes two scroll suction openings 34*b* formed in both side surfaces in order to configure a double suction type centrifugal fan and a scroll blowout opening 35*b* formed so as to blow out air in the direction intersecting the scroll suction openings 34*b*. Here, the scroll suction openings 34*b* open in the direction of the rotational axis O of the impeller 31*b*. For this reason, the unit suction opening 2*a* opens in the direction intersecting (more specifically, the direction orthogonal to) the opening direction of the scroll suction openings 34*b*. Further, the scroll blowout opening 35*b* is disposed so as to correspond to the communication opening 25*b* in the partition member 24.

More specifically, in the present embodiment, the scroll casing 32*b* is a member made of resin and has a divided structure comprising a scroll lower member 45*b* that covers the impeller 31*b* from below and a scroll upper member 44*b* that covers the impeller 31*b* from above. Additionally, by attaching these members 44*b* and 45*b* to each other, a scroll body section 36*b* that includes the two scroll suction openings 34*b* and houses the impeller 31*b* and a scroll outlet section 37*b* that includes the scroll blowout opening 35*b* and is communicated with the scroll body section 36*b* are configured. Two bellmouth sections 38*b* that surround the scroll suction openings 34*b* are formed in the scroll body section 36*b*. Inner peripheral end portions of the bellmouth sections 38*b* curve in bell shapes toward the impeller 31*b*. The scroll outlet section 37*b* is a portion shaped like a square cylinder that is communicated with the portion at the partition member 24 side of the scroll body section 36*b*, and the distal end portion of the scroll outlet section 37*b* is inserted into the communication opening 25*b* formed in the flat plate section 25 of the partition member 24 and projects toward the heat exchanger 4 from the flat plate section 25 of the partition member 24. The scroll outlet section 37*b* extends directly in a direction substantially orthogonal to the flat plate section 25—that is, in a direction orthogonal to the rotational axis O—when the unit casing 2 is seen in plan view and slants somewhat downward so as to blow out air a little downward when the unit casing 2 is seen in side view.

It will be noted that, although there are four impellers and four scroll casings in the present embodiment, the number of impellers and scroll casings is not limited to this and may also be one, two, or four or more. Further, although the impellers and the scroll casings are a double suction type in the present embodiment, they may also be a single suction type.

In the present embodiment, the motor 33 is disposed between the scroll casing 32*b* and the scroll casing 32*c* (i.e., on the rotational axis O direction sides of the scroll casing 32*b* and the scroll casing 32*c*) when the unit casing 2 is seen in plan view, and is fixed to the partition member 24 and the unit casing 2 via a support member 33*a*. For this reason, just the distance between the scroll casing 32*b* and the scroll casing 32*c* is larger in comparison to the distances between the other scroll casings (more specifically, the distance between the scroll casing 32*a* and the scroll casing 32*b* and the distance between the scroll casing 32*c* and the scroll casing 32*d*). Additionally, the four impellers 31*a* to 31*d* are all coupled to the motor 33 so that they can be collectively driven to rotate.

When the centrifugal fan 3 is actuated, air is sucked into the fan chamber S1 of the unit casing 2 via the unit suction opening 2*a*, and the air that has been sucked into the fan chamber S1 is sucked into the scroll casings 32*a* to 32*d* through the scroll suction openings 34*a* to 34*d* and blown out from the inner peripheral sides to the outer peripheral sides of the impellers 31*a* to 31*d*. The air that has been blown out to the outer peripheral sides of the impellers 31*a* to 31*d* and whose pressure has been boosted is blown out into the heat exchanger chamber S2 from the scroll blowout openings 35*a* to 35*d* in the scroll casings 32*a* to 32*d* disposed so as to correspond to the communication openings 25*a* to 25*d* in the partition member 24.

<Heat Exchanger>

The heat exchanger 4 is disposed inside the heat exchanger chamber S2 and is a device for cooling or heating the air whose pressure has been boosted by the centrifugal fan 3 inside the fan chamber S1 and which has been blown out into the heat exchanger chamber S2 from the scroll blowout openings 35*a* to 35*d* in the scroll casings 32*a* to 32*d*. In the present embodiment, the heat exchanger 4 is a cross fin tube type heat exchanger and is disposed facing, and parallel to, substantially the entire flat plate section 25 of the partition member 24. For this reason, the heat exchanger 4 is disposed facing the scroll blowout openings 35*a* to 35*d* in the scroll outlet sections 37*a* to 37*d*. Further, the heat exchanger 4 is disposed such that its upper portion slants toward the unit blowout opening 2*b*. Additionally, the drain pan 28 is disposed below the heat exchanger 4 so that condensation water generated by the heat exchanger 4 can be received.

Thus, the air that has been blown out into the heat exchanger chamber S2 from the scroll blowout openings 35*a* to 35*d* is cooled or heated as a result of heat exchange being performed with refrigerant flowing inside a heat transfer tube of the heat exchanger 4 and is blown out into the room from the unit blowout opening 2*b*.

Figure 3:
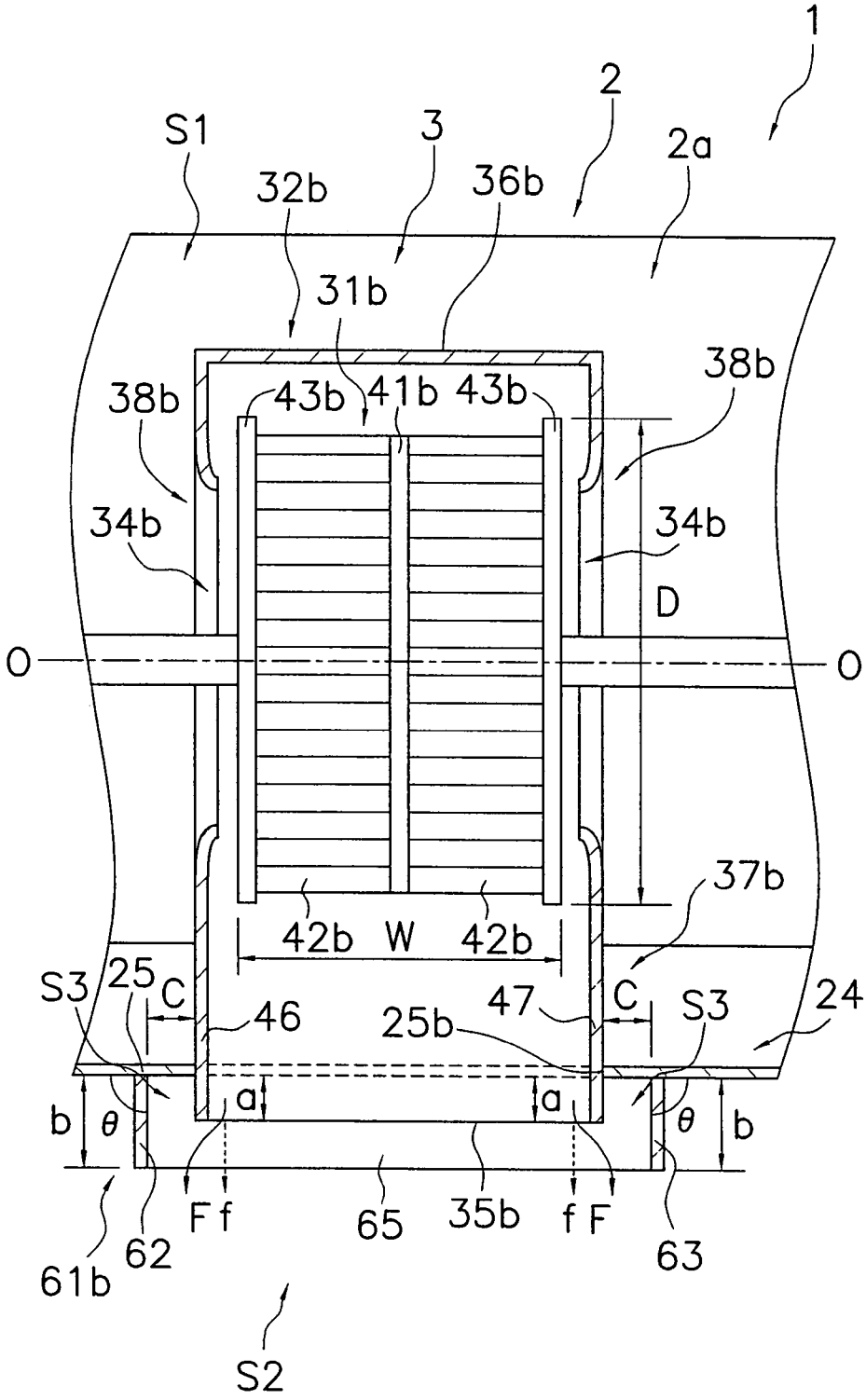
FIG. 3 is an enlarged view of FIG. 2 showing the structure of the vicinity of an impeller and a scroll casing.
Figure 4:
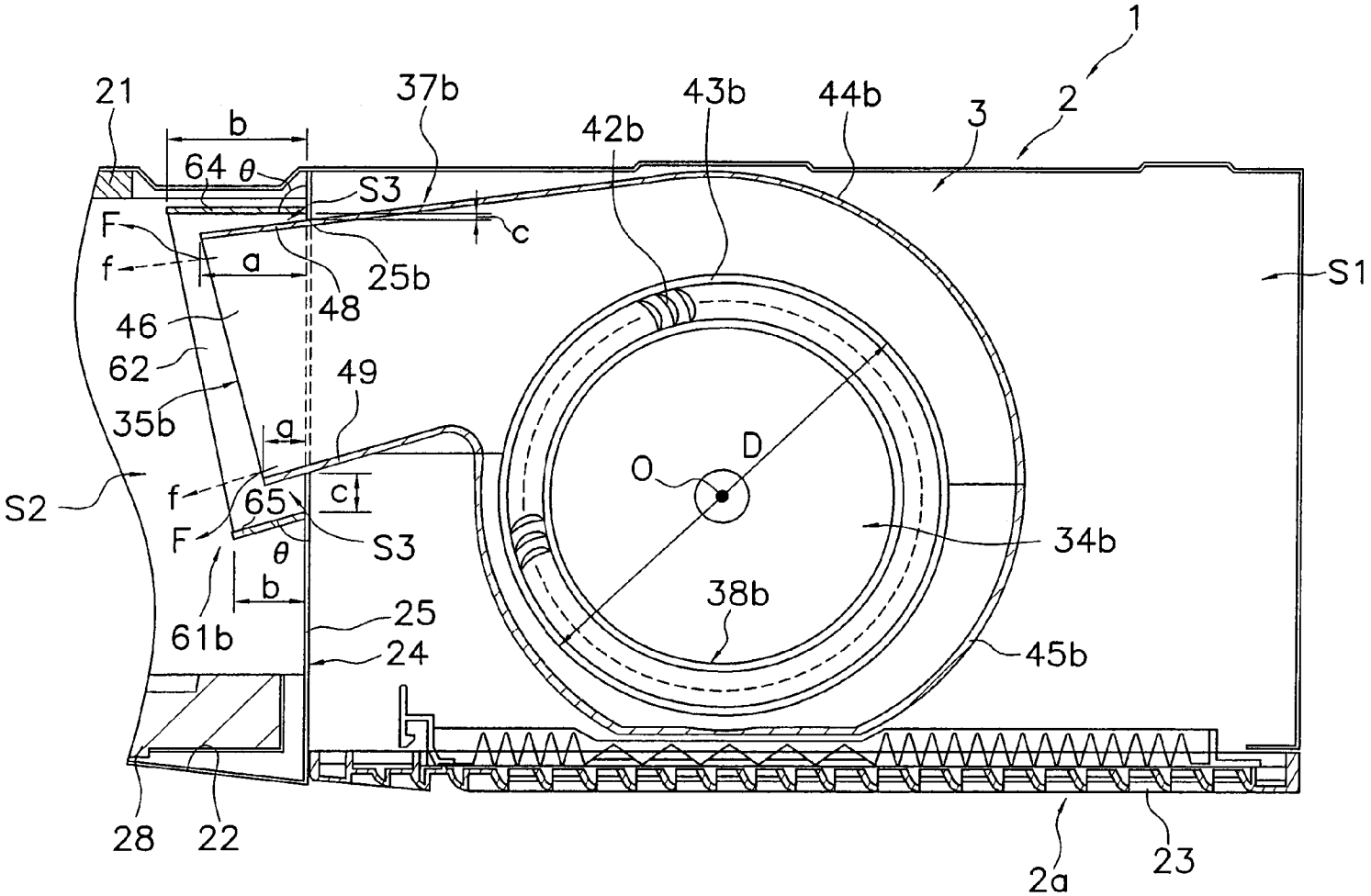
FIG. 4 is an enlarged view of FIG. 1 showing the structure of the vicinity of the impeller and the scroll casing.

In the air conditioner 1 disposed with the above-described configuration, wall sections 61*a* to 61*d* are further disposed. These wall sections 61*a* to 61*d* will be described below using FIG. 1 to FIG. 4. Here, FIG. 3 is an enlarged view of FIG. 2 and shows the structure of the vicinity of the impeller 31*b* and the scroll casing 32*b*. FIG. 4 is an enlarged view of FIG. 1 and shows the structure of the vicinity of the impeller 31*b* and the scroll casing 32*b*.

<Wall Sections>

As shown in FIG. 2, FIG. 3, and FIG. 4, the wall sections 61*a* to 61*d* are portions that project from the heat exchanger 4 side of the flat plate section 25 of the partition member 24 disposed on the outside of the scroll outlet sections 37*a* to 37*d*. It will be noted that, because the wall sections 61*a* to 61*d* all have the same structure in the present embodiment, just the configuration of the wall section 61*b* will be described here, and in regard to the configurations of the wall sections 61*a*, 61*c*, and 61*d*, the letters a, c, and d will be added instead of the letter b representing the respective parts of the wall section 61*b* and description of those respective parts will be omitted.

In the present embodiment, the wall section 61*b* is a cylindrical portion disposed so as to surround the outside of the cylindrical scroll outlet section 37*b* and includes side wall sections 62 and 63 respectively disposed on the sides of both side surface portions 46 and 47 of the scroll outlet section 37*b*, an upper wall section 64 disposed above an upper surface portion 48 of the scroll outlet section 37*b*, and a lower wall section 65 disposed below a lower surface portion 49 of the scroll outlet section 37*b*. Additionally, the wall section 61*b* (specifically, the side wall sections 62 and 63, the upper wall section 64, and the lower wall section 65) at the fan chamber S1 side contacts a position outside the communication opening 25*b* on the flat plate section 25 of the partition member 24 and extends from there so as to project toward the heat exchanger 4. In the air conditioner 1 of the present embodiment, by disposing the wall section 61*b*, a portion (called negative pressure portion S3 below) whose pressure is lower than the pressure of the air blown out into the heat exchanger chamber S2 from the scroll blowout opening 35*b* is formed in the outside vicinity of the scroll blowout opening 35*b*. It will be noted that it is not necessary for the wall section 61*b* to be disposed around the outside of the entire scroll blowout opening 35*b* as in the present embodiment and that the wall section 61*b* may also be disposed just where the negative pressure portion S3 is to be formed in the outside vicinity of the scroll blowout opening 35*b*. For example, when the negative pressure portion S3 is to be formed just on the sides of the scroll blowout opening 35*b*, just the side wall sections 62 and 63 may be disposed without disposing the upper wall section 64 and the lower wall section 65.

Further, in the present embodiment, a distance c between the portion where the scroll outlet section 37*b* and the surface of the flat plate section 25 on the heat exchanger 4 side intersect and the portion where the wall section 61*b* and the surface of the flat plate section 25 on the heat exchanger 4 side intersect is equal to or less than 0.5 times a rotor width W of the impeller 31*b*. More specifically, a distance c between the portion where the outer surface of the side surface portion 46 of the scroll outlet section 37*b* (i.e., the surface on the side of the side wall section 62 of the wall section 61*b*) and the surface of the flat plate section 25 on the heat exchanger 4 side intersect and the portion where the inner surface of the side wall section 62 of the wall section 61*b* (i.e., the surface on the side of the side surface portion 46 of the scroll outlet section 37*b*) and the surface of the flat plate section 25 on the heat exchanger 4 side intersect, a distance c between the portion where the outer surface of the side surface portion 47 of the scroll outlet section 37*b* (i.e., the surface on the side of the side wall section 63 of the wall section 61*b*) and the surface of the flat plate section 25 on the heat exchanger 4 side intersect and the portion where the inner surface of the side wall section 63 of the wall section 61*b* (i.e., the surface on the side of the side surface portion 47 of the scroll outlet section 37*b*) and the surface of the flat plate section 25 on the heat exchanger 4 side intersect, a distance c between the portion where the outer surface of the upper surface portion 48 of the scroll outlet section 37*b* (i.e., the surface on the side of the upper wall section 64 of the wall section 61*b*) and the surface of the flat plate section 25 on the heat exchanger 4 side intersect and the portion where the inner surface of the upper wall section 64 of the wall section 61*b* (i.e., the surface on the side of the upper wall section 48 of the scroll outlet section 37*b*) and the surface of the flat plate section 25 on the heat exchanger 4 side intersect, and a distance c between the portion where the outer surface of the lower surface portion 49 of the scroll outlet section 37*b* (i.e., the surface on the side of the lower wall section 65 of the wall section 61*b*) and the surface of the flat plate section 25 on the heat exchanger 4 side intersect and the portion where the inner surface of the lower wall section 65 of the wall section 61*b* (i.e., the surface on the side of the lower surface portion 49 of the scroll outlet section 37*b*) and the surface of the flat plate section 25 on the heat exchanger 4 side intersect are equal to or less than 0.5 times the rotor width W of the impeller 31*b*. In the air conditioner 1 of the present embodiment, by making the distance c equal to or less than 0.5 times the rotor width W, the negative pressure portion S3 can be reliably formed in the outside vicinity of the scroll blowout opening 35*b*. It will be noted that, when the wall section 61*b* does not contact the flat plate section 25, the portion where the wall section 61*b* and the surface of the flat plate section 25 on the heat exchanger 4 side would intersect if the end portion of the wall section 61*b* on the flat plate section 25 side were to be extended corresponds to the portion where the wall section 61*b* and the surface of the flat plate section 25 on the heat exchanger 4 side intersect.

Further, in the present embodiment, a distance a from the surface of the flat plate section 25 on the heat exchanger 4 side to the end portion of the scroll outlet section 37*b* on the heat exchanger 4 side is greater than 0 and equal to or less than 0.3 times a rotor diameter D of the impeller 31*b*. More specifically, a distance a from the surface of the flat plate section 25 on the heat exchanger 4 side to the end portions of both side surface portions 46 and 47 of the scroll outlet section 37*b* on the heat exchanger 4 side, a distance a from the surface of the flat plate section 25 on the heat exchanger 4 side to the end portion of the upper surface portion 48 of the scroll outlet section 37*b* on the heat exchanger 4 side, and a distance a from the surface of the flat plate section 25 on the heat exchanger 4 side to the end portion of the lower surface portion 49 of the scroll outlet section 37*b* on the heat exchanger 4 side are greater than 0 and equal to or less than 0.3 times the rotor diameter D of the impeller 31*b*. In the air conditioner 1 of the present embodiment, by making the distance a greater than 0—that is, by allowing the end portion of the scroll outlet section 37*b* on the heat exchanger 4 side to project toward the heat exchanger chamber S2—the negative pressure portion S3 comprising space interposed between the wall section 61*b* and the end portion of the scroll outlet section 37*b* on the heat exchanger 4 side can be formed in the outside vicinity of the scroll blowout opening 35*b*.

Further, in the present embodiment, a distance b from the surface of the flat plate section 25 on the heat exchanger 4 side to the end portion of the wall section 61*b* on the heat exchanger 4 side is equal to or greater than the distance a and equal to or less than 0.5 times the rotor diameter D of the impeller 31*b*. More specifically, a distance b from the surface of the flat plate section 25 on the heat exchanger 4 side to the end portions of the side wall sections 62 and 63 of the wall section 61*b* on the heat exchanger 4 side, a distance b from the surface of the flat plate section 25 on the heat exchanger 4 side to the end portion of the upper wall section 64 of the wall section 61*b* on the heat exchanger 4 side, and a distance b from the surface of the flat plate section 25 on the heat exchanger 4 side to the end portion of the lower wall section 65 of the wall section 61*b* on the heat exchanger 4 side are equal to or greater than the distance a and equal to or less than 0.5 times the rotor diameter D of the impeller 31*b*. In the air conditioner 1 of the present embodiment, by making the distance b equal to or greater than the distance a—that is, by allowing the end portion of the wall section 61*b* to project further toward the heat exchanger 4 than the end portion of the scroll outlet section 37*b* on the heat exchanger 4 side—the difference in pressure between the pressure of the negative pressure portion S3 comprising space interposed between the wall section 61*b* and the end portion of the scroll outlet section 37*b* on the heat exchanger 4 side and the pressure of the air blown out into the heat exchanger chamber S2 from the scroll blowout opening 35*b* can be made greater.

Further, in the present embodiment, an angle θ formed by the wall section 61 and the surface of the flat plate section 25 on the heat exchanger 4 side is greater than 30° and equal to or less than 90°. More specifically, the angle θ formed by the inner surfaces of the side wall sections 62 and 63 of the wall section 61*b* (i.e., the surfaces on the sides of the side surface portions 46 and 47 of the scroll outlet section 37*b*) and the portion of the surface of the flat plate section 25 on the heat exchanger 4 side outside the side wall sections 62 and 63 of the wall section 61*b*, the angle θ formed by the inner surface of the upper wall section 64 of the wall section 61*b* (i.e., the surface on the side of the upper surface portion 48 of the scroll outlet section 37*b*) and the portion of surface of the flat plate section 25 on the heat exchanger 4 side outside the upper wall section 64 of the wall section 61*b*, and the angle θ formed by the inner surface of the lower wall section 65 of the wall section 61*b* (i.e., the surface on the side of the lower surface portion 49 of the scroll outlet section 37*b*) and the portion of the surface of the flat plate section 25 on the heat exchanger 4 side outside the lower wall section 65 of the wall section 61*b* are greater than 30° and equal to or less than 90°. In the air conditioner 1 of the present embodiment, by making the angle formed by the wall section 61*b* and the surface of the flat plate section 25 on the heat exchanger 4 side greater than 30°, the negative pressure portion S3 can be reliably formed in the outside vicinity of the scroll blowout opening 35*b*.

(2) Operation of Air Conditioner

Next, operation of the air conditioner 1 of the present embodiment will be described using FIG. 1 to FIG. 4.

When the motor 33 is started to actuate the centrifugal fan 3, air is sucked into the fan chamber S1 of the unit casing 2 via the unit suction opening 2*a*, and the air that has been sucked into the fan chamber S1 is sucked into the scroll casings 32*a* to 32*d* through the scroll suction openings 34*a* to 34*d* and is blown out from the inner peripheral sides to the outer peripheral sides of the impellers 31*a* to 31*d*. The air that has been blown out to the outer peripheral sides of the impellers 31*a* to 31*d* and whose pressure has been boosted is blown out into the heat exchanger chamber S2 from the scroll blowout openings 35*a* to 35*d* disposed so as to correspond to the communication openings 25*a* to 25*d* in the partition member 24. Then, the air that has been blown out into the heat exchanger chamber S2 from the scroll blowout openings 35*a* to 35*d* is cooled or heated as a result of heat exchange being performed with refrigerant flowing inside the heat transfer tube of the heat exchanger 4 and is blown out into the room from the unit blowout opening 2*b*.

Here, in the air conditioner 1 of the present embodiment, the wall sections 61*a* to 61*d* that project from the heat exchanger 4 side of the flat plate section 25 are disposed outside the scroll outlet sections 37*a* to 37*d*, so that the negative pressure portions S3 whose pressure is lower than the pressure of the air blown out into the heat exchanger chamber S2 from the scroll blowout openings 35*a* to 35*d* are formed in the outside vicinities of the scroll blowout openings 35*a* to 35*d*. Additionally, the air blown out into the heat exchanger chamber S2 from the scroll blowout openings 35*a* to 35*d* (see arrow F in FIG. 3 and in FIG. 4) flows so as to be pulled into the negative pressure portions S3, so that the air is diffused to the outsides of the scroll blowout openings 35*a* to 35*d* in comparison to when wall sections are not disposed in the scroll outlet sections (see arrow f showing the flow of air when wall sections are not disposed in the scroll outlet sections). Thus, nonuniformity in the flow of air passing through the heat exchanger 4 can be controlled while controlling a reduction in blowing capability.

Further, in the air conditioner 1 of the present embodiment, by making the distance c equal to or less than 0.5 times the rotor width W of the impellers 31*a* to 31*d*, the negative pressure portions S3 can be reliably formed in the outside vicinities of the scroll blowout openings 35*a* to 35*d*.

Further, in the air conditioner 1 of the present embodiment, by making the distance a greater than 0—that is, by allowing the end portions of the scroll outlet sections 37*a* to 37*d* on the heat exchanger 4 side to project toward the heat exchanger chamber S2—the negative pressure portions S3 comprising spaces interposed between the wall sections 61*a* to 61*d* and the end portions of the scroll outlet sections 37*a* to 37*d* on the heat exchanger 4 side can be formed in the outside vicinities of the scroll blowout openings 35*a* to 35*d* where the effect of causing the air blown out into the heat exchanger chamber S2 from the scroll blowout openings 35*a* to 35*d* to be diffused outside the scroll blowout openings 35*a* to 35*d* is large. Moreover, by making the distance a equal to or less than 0.3 times the rotor diameter D of the impellers 31*a* to 31*d*, a distance that is sufficient for the air blown out into the heat exchanger chamber S2 from the scroll blowout openings 35*a* to 35*d* to diffuse outside the scroll blowout openings 35*a* to 35*d* can be ensured between the scroll blowout openings 35*a* to 35*d* and the heat exchanger 4.

Further, in the air conditioner 1 of the present embodiment, by making the distance b equal to or greater than the distance a—that is, by allowing the end portions of the wall sections 61*a* to 61*d* to project further toward the heat exchanger 4 than the end portions of the scroll outlet sections 37*a* to 37*d* on the heat exchanger 4 side—the difference in pressure between the pressure of the negative pressure portions S3 comprising spaces interposed between the wall sections 61*a* to 61*d* and the end portions of the scroll outlet sections 37*a* to 37*d* on the heat exchanger 4 side and the pressure of the air blown out into the heat exchanger chamber S2 from the scroll blowout openings 35*a* to 35*d* can be made greater, so that the effect of causing the air blown out into the heat exchanger chamber S2 from the scroll blowout openings 35*a* to 35*d* to be diffused to the outsides of the scroll blowout openings 35*a* to 35*d* can be raised. Moreover, by making the distance b equal to or less than 0.5 times the rotor diameter D of the impellers 31*a* to 31*d*, it can be ensured that the flow of air to be diffused by the negative pressure portions S3 to the outsides of the scroll blowout openings 35*a* to 35*d* is, as much as possible, not restricted by the wall sections 61*a* to 61*d*, so that the air blown out into the heat exchanger chamber S2 from the scroll blowout openings 35*a* to 35*d* can be further diffused to the outsides of the wall sections 61*a* to 61*d*.

Further, in the air conditioner 1 of the present embodiment, by making the angle θ greater than 30°, the negative pressure portions S3 can be reliably formed in the outside vicinities of the scroll blowout openings 35*a* to 35*d*. Moreover, by making the angle θ equal to or less than 90°, it can be ensured that the air blown out into the heat exchanger chamber S2 from the scroll blowout openings 35*a* to 35*d* is reliably diffused to the outsides of the scroll blowout openings 35*a* to 35*d*.

In this manner, in the air conditioner 1 of the present embodiment, whereas the heat exchanger 4 faces substantially the entire flat plate section 25 of the partition member 24, the communication openings 25*a* to 25*d* in the flat plate section 25—that is, the scroll blowout openings 35*a* to 35*d* in the scroll casings 32*a* to 32*d*—are only disposed partially in the flat plate section 25 of the partition member 24, but by disposing the wall sections 61*a* to 61*d* as described above, the air blown out into the heat exchanger chamber S2 from the scroll blowout openings 35*a* to 35*d* can be diffused to the outsides of the scroll blowout openings 35*a* to 35*d* and allowed to pass through the heat exchanger 4 without having to increase the size of the scroll blowout openings 35*a* to 35*d*, and nonuniformity in the flow of air passing through the heat exchanger 4 can be controlled.

Moreover, because the wall sections 61*a* to 61*d* are disposed on the heat exchanger chamber S2 side of the flat plate section 25 of the partition member 24, problems do not arise where the wall sections 61*a* to 61*d* hinder the scroll suction openings 34*a* to 34*d* such that dynamic pressure recovery in the scroll outlet sections 37*a* to 37*d* becomes difficult, and the wall sections 61*a* to 61*d* are effective as means to control nonuniformity in the flow of air passing through the heat exchanger 4 when there is no extra space inside the fan chamber S1 or when the unit casing 2 must be made compact.

(3) Modification 1

Figure 5:
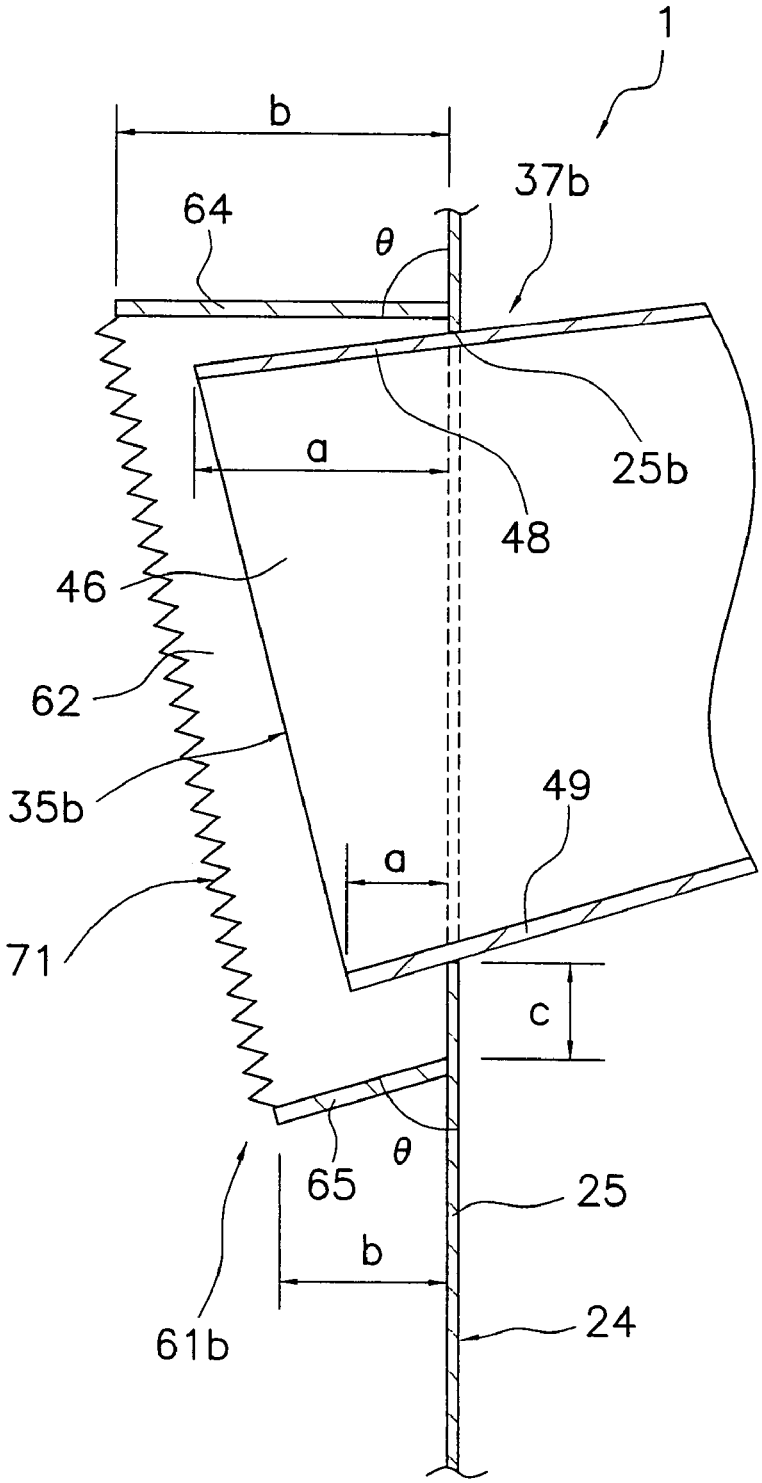
FIG. 5 is a view showing the structure of the vicinity of a scroll outlet section in an air conditioner pertaining to a first modification of the first embodiment.

Further, serrations may be disposed in the end portions of the wall sections 61*a* to 61*d* on the heat exchanger 4 side. To describe using the wall section 61*b* as an example, as shown in FIG. 5, it is possible to dispose triangular wave-shaped serrations 71 in the end portion of the wall section 61*b* on the heat exchanger 4 side (in FIG. 5, there is shown a drawing where the serrations 71 are disposed in the side wall section 62, but the same serrations 71 may also be disposed in the other wall sections 63 to 65).

In this manner, by disposing the serrations 71 in the end portions of the wall sections 61*a* to 61*d* on the heat exchanger 4 side, variations in the pressure of the air blown out into the heat exchanger chamber S2 from the scroll blowout openings 35*a* to 35*d* at the end portions of the wall sections 61*a* to 61*d* on the heat exchanger 4 side can be controlled. Thus, the occurrence of noise resulting from pressure variations at the end portions of the wall sections 61*a* to 61*d* on the heat exchanger 4 side can be controlled.

(4) Modification 2

Figure 6:
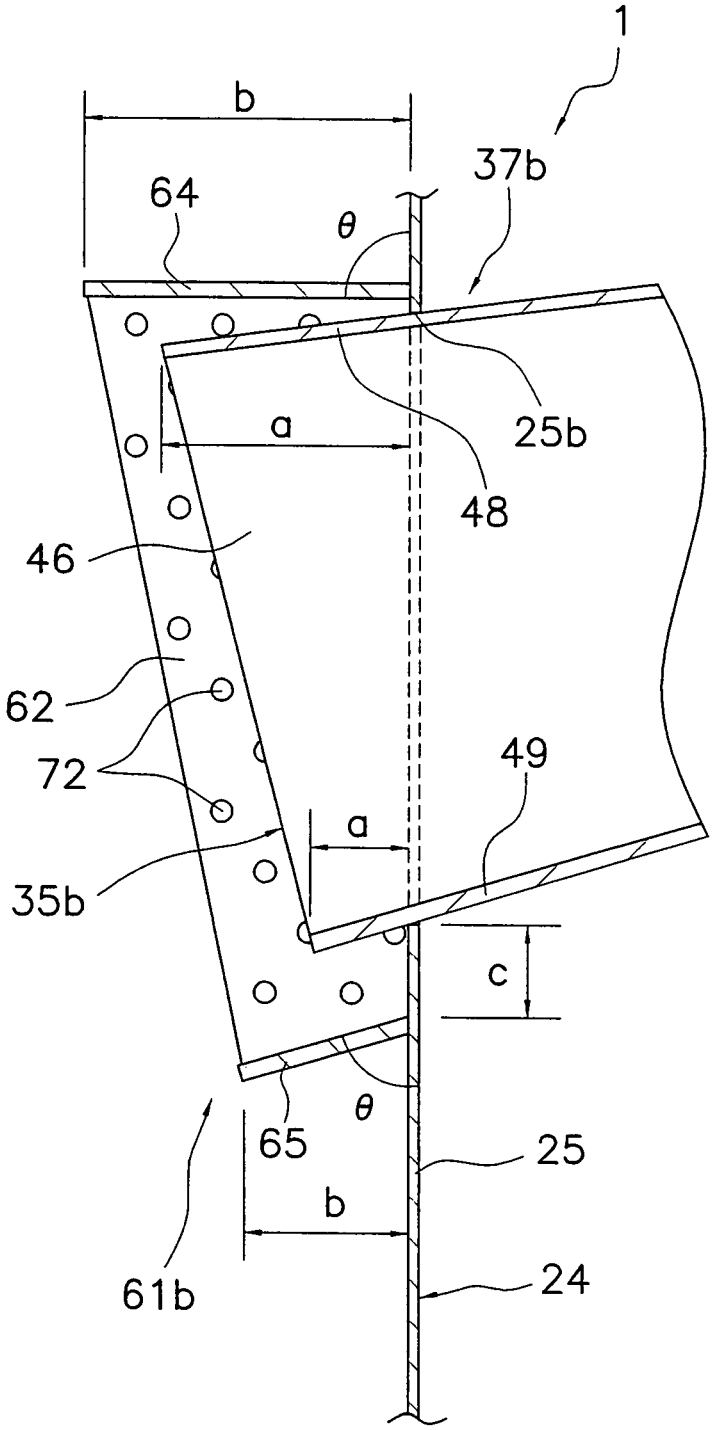
FIG. 6 is a view showing the structure of the vicinity of a scroll outlet section in an air conditioner pertaining to a second modification of the first embodiment.

Further, plural dimples may be disposed in the inner surfaces of the wall sections 61*a* to 61*d*—that is, the surfaces of the wall sections 61*a* to 61*d* on the sides of the scroll outlet sections 37*a* to 37*d*. To describe using the wall section 61*b* as an example, as shown in FIG. 6, it is possible to dispose plural dimples 72 in the inner surface of the wall section 61*b*—that is, the surface of the wall section 61*b* on the scroll outlet section 37*b* side (in FIG. 6, there is shown a drawing where the plural dimples 72 are disposed in the side wall section 62, but the same plural dimples 72 may also be disposed in the other wall sections 63 to 65).

In this manner, by disposing the plural dimples 72 in the inner surfaces of the wall sections 61*a* to 61*d*—that is, the surfaces of the wall sections 61*a* to 61*d* on the sides of the scroll outlet sections 37*a* to 37*d*—the air blown out into the heat exchanger chamber S2 from the scroll blowout openings 35*a* to 35*d* can be matched to the surfaces of the wall sections 61*a* to 61*d* on the sides of the scroll outlet sections 37*a* to 37*d*. Thus, the effect of causing the air blown out into the heat exchanger chamber S2 from the scroll blowout openings 35*a* to 35*d* to be diffused to the outsides of the scroll blowout openings 35*a* to 35*d* can be raised.

Figure 7:
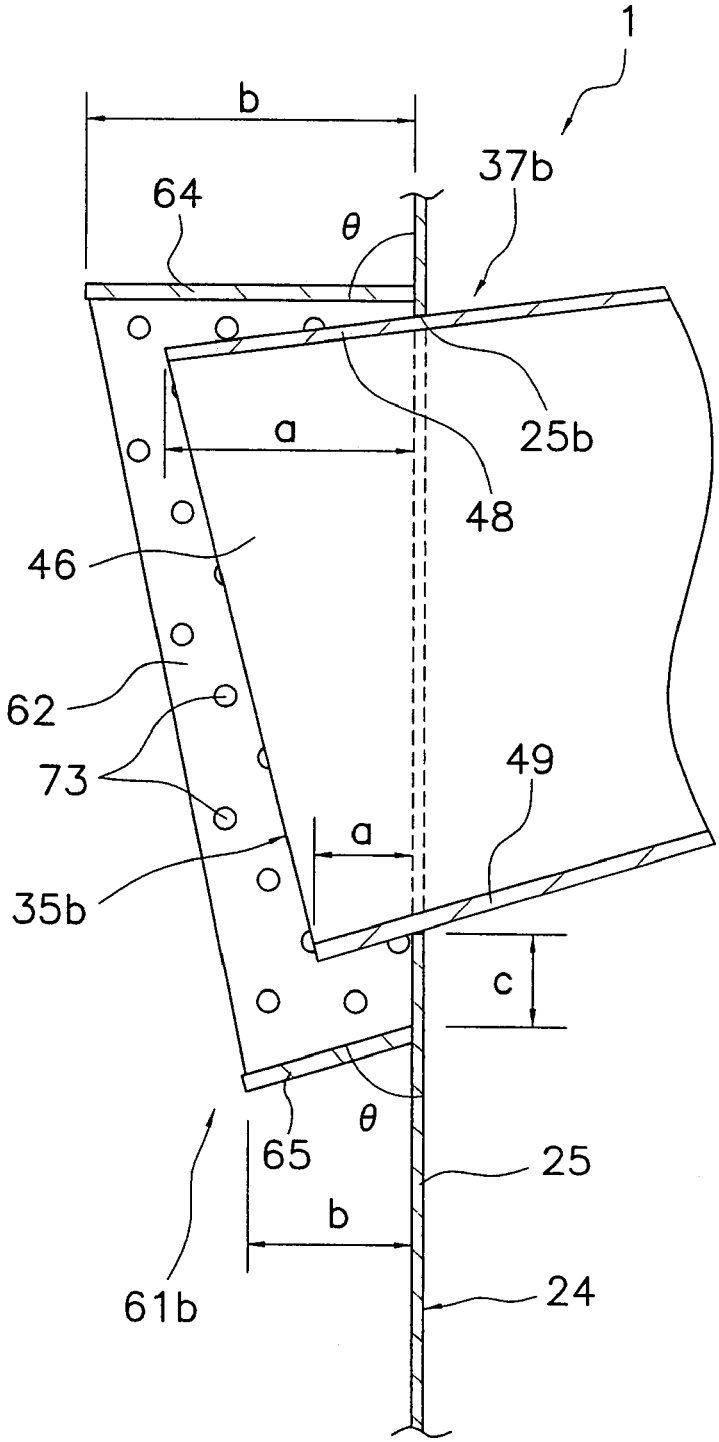
FIG. 7 is a view showing the structure of the vicinity of the scroll outlet section in the air conditioner pertaining to the second modification of the first embodiment.

Further, in order to obtain the same effect as disposing plural dimples in the inner surfaces of the wall sections 61*a* to 61*d*—that is, the surfaces of the wall sections 61*a* to 61*d* on the sides of the scroll outlet sections 37*a* to 37*d*—plural through holes 73 may be disposed in the wall sections 61*a* to 61*d*. To describe using the wall section 61*b* as an example, as shown in FIG. 7, it is possible to dispose the plural through holes 73 in the wall section 61*b* (in FIG. 7, there is shown a drawing where the plural through holes 73 are disposed in the side wall section 62, but the same plural through holes 73 may also be disposed in the other wall sections 63 to 65).

(5) Modification 3

Figure 8:
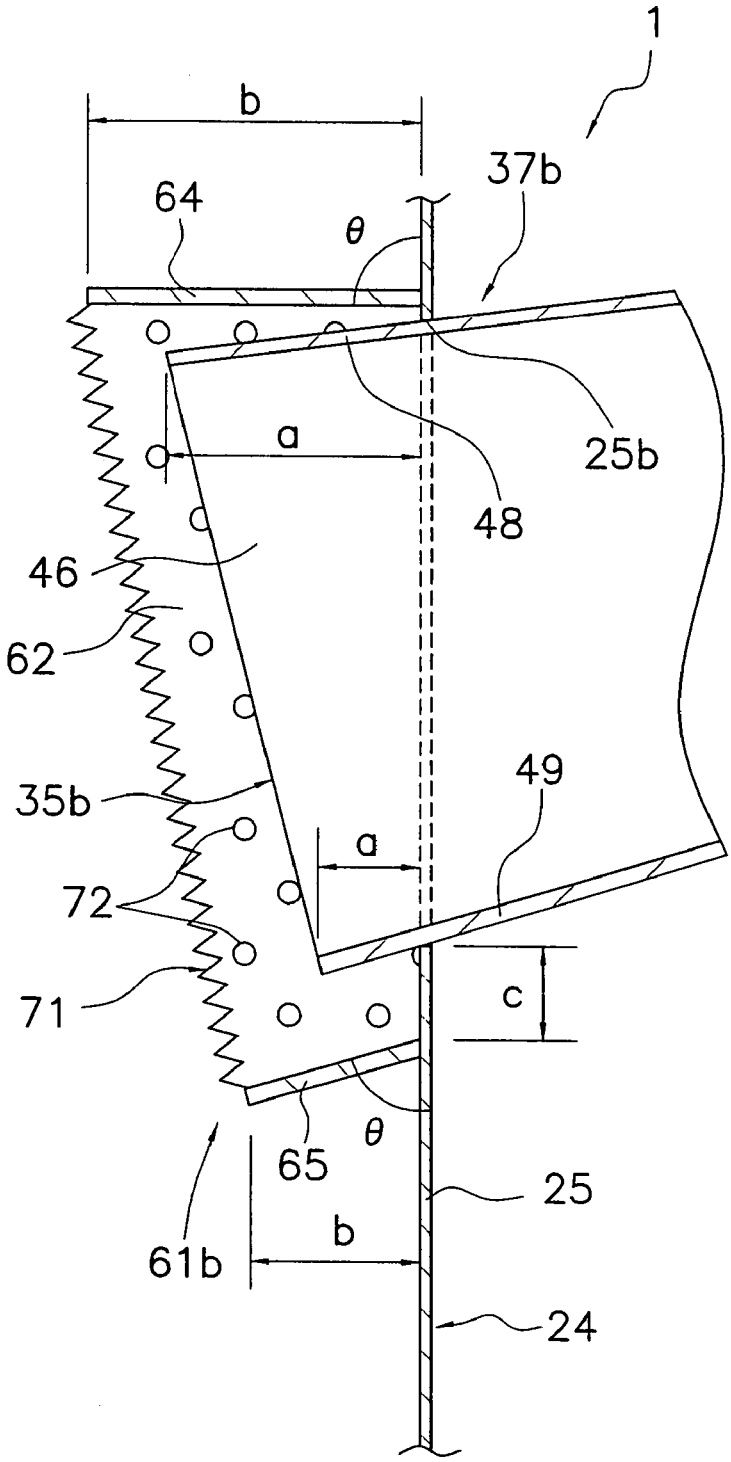
FIG. 8 is a view showing the structure of the vicinity of a scroll outlet section in an air conditioner pertaining to a third modification of the first embodiment.

Further, the serrations pertaining to modification 1 and the plural dimples or through holes pertaining to modification 2 may be simultaneously disposed in the wall sections 61*a* to 61*d*. To describe using the wall section 61*b* as an example, as shown in FIG. 8, it is possible to dispose the triangular wave-shaped serrations 71 in the end portion of the wall section 61*b* on the heat exchanger 4 side and to dispose the plural dimples 72 in the inner surface of the wall section 61*b*—that is, the surface of the wall section 61*b* on the scroll outlet section 37*b* side (in FIG. 8, there is shown a drawing where the serrations 71 are disposed in the side wall section 62 and where the plural dimples 72 are disposed in the side wall section 62, but the same serrations 71 and plural dimples 72 may also be disposed in the other wall sections 63 to 65; further, plural through holes may be disposed instead of the plural dimples 72).

Thus, the effects of both modification 1 and modification 2 can be obtained.

(6) Modification 4

Further, in the air conditioner 1 of the above first embodiment (including modifications 1 to 3), the impellers 31*a* to 31*d* are disposed so as to rotate about the rotational axis O along the flat plate section 25 of the partition member 24, and the motor 33 that drives the impellers 31*a* to 31*d* to rotate is disposed on the rotational axis O direction sides of the scroll casings 32*a* to 32*d* inside the fan chamber S1.

For this reason, the air blown out into the heat exchanger chamber S2 from the scroll blowout openings 35*a* to 35*d* in the scroll casings 32*a* to 32*d* mainly ends up passing through the portions of the heat exchanger 4 facing the scroll casings 32*a* to 32*d* with the flat plate section 25 interposed therebetween and it becomes difficult for the air to pass through the portion of the heat exchanger 4 facing the motor 33 with the flat plate section 25 interposed therebetween (specifically, the portion between the scroll casing 32*b* and the scroll casing 32*c*), so it becomes easy for problems to occur in which nonuniformity in the flow of air passing through the heat exchanger 4 occurs, ventilation resistance in the heat exchanger 4 increases, and blowing capability and heat exchange capability decrease.

Figure 9:
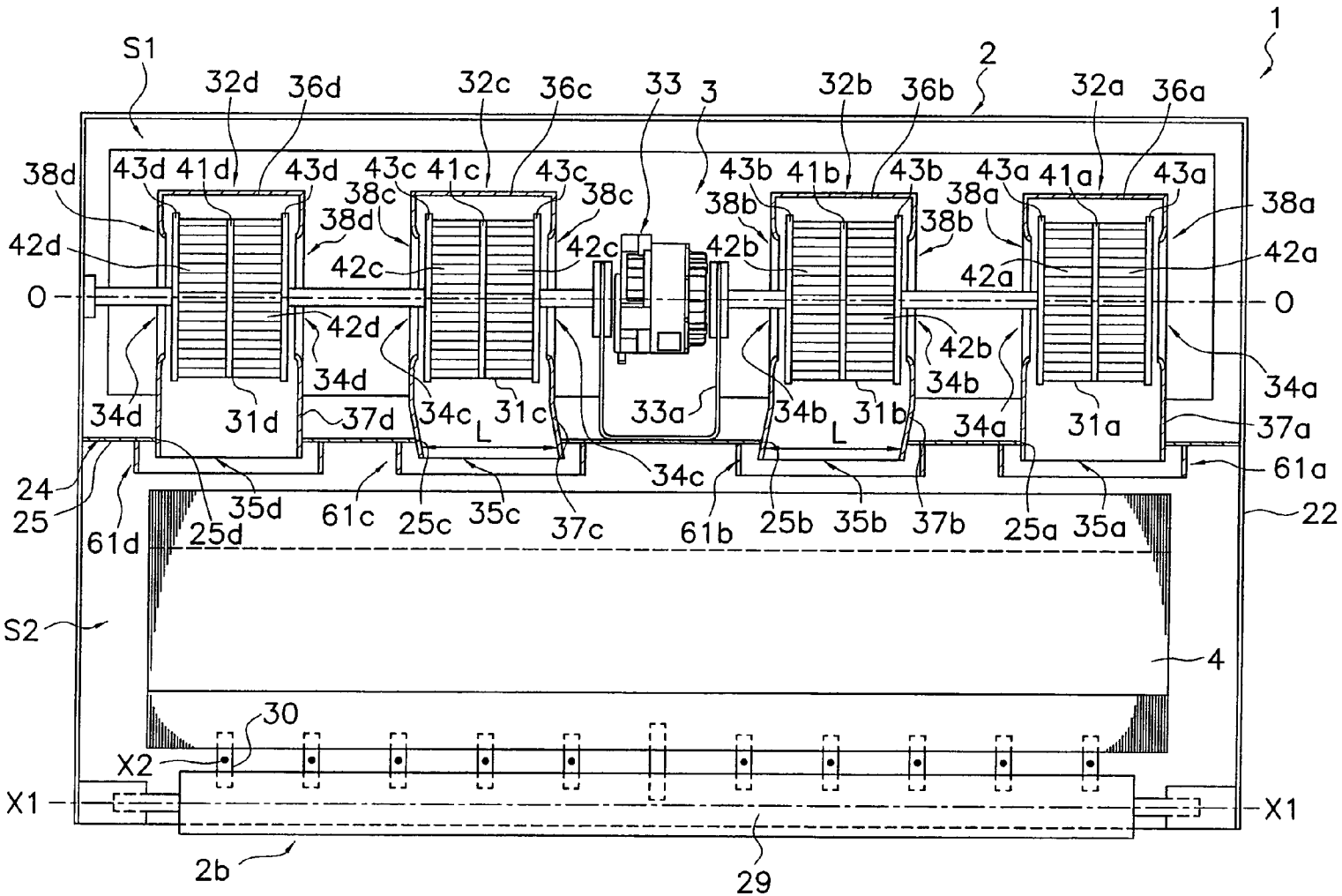
FIG. 9 is a view corresponding to FIG. 2 and showing an air conditioner pertaining to a fourth modification of the first embodiment.

With respect to this, in the air conditioner 1 of the present modification, as shown in FIG. 9, the scroll outlet sections 37*b* and 37*c* of the scroll casings 32*b* and 32*c* extend toward the communication openings 25*b* and 25*c* while slanting toward the motor 33 but without their size L in the rotational axis O direction being enlarged, so it becomes easier for the air blown out into the heat exchanger chamber S2 to also pass through the portion of the heat exchanger 4 facing the motor 33 with the flat plate section 25 interposed therebetween, and nonuniformity in the flow of air passing through the heat exchanger 4 can be controlled. Moreover, because it is ensured that the size L of the scroll outlet sections 37*b* and 37*c* in the rotational axis O direction is not enlarged, it also becomes difficult for drawbacks such as dynamic pressure recovery in the scroll outlet sections 37*b* and 37*c* becoming difficult to occur, and a reduction in blowing performance can be controlled.

Second Embodiment (1) Basic Structure of Air Conditioner

Figure 10:
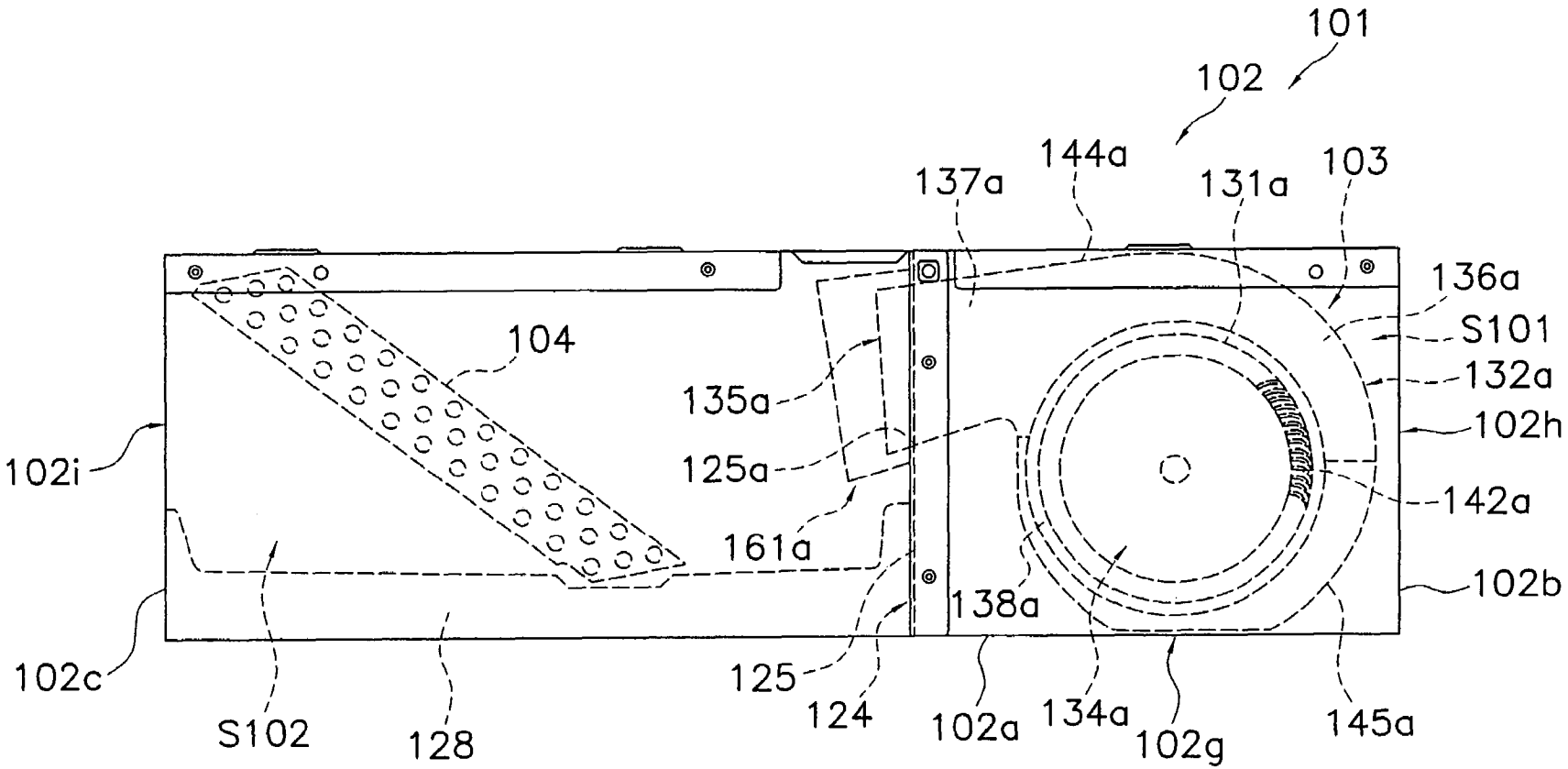
FIG. 10 is a side view (seen from arrow A in FIG. 11) of a duct type air conditioner serving as a second embodiment of the air conditioner pertaining to the present invention.
Figure 11:
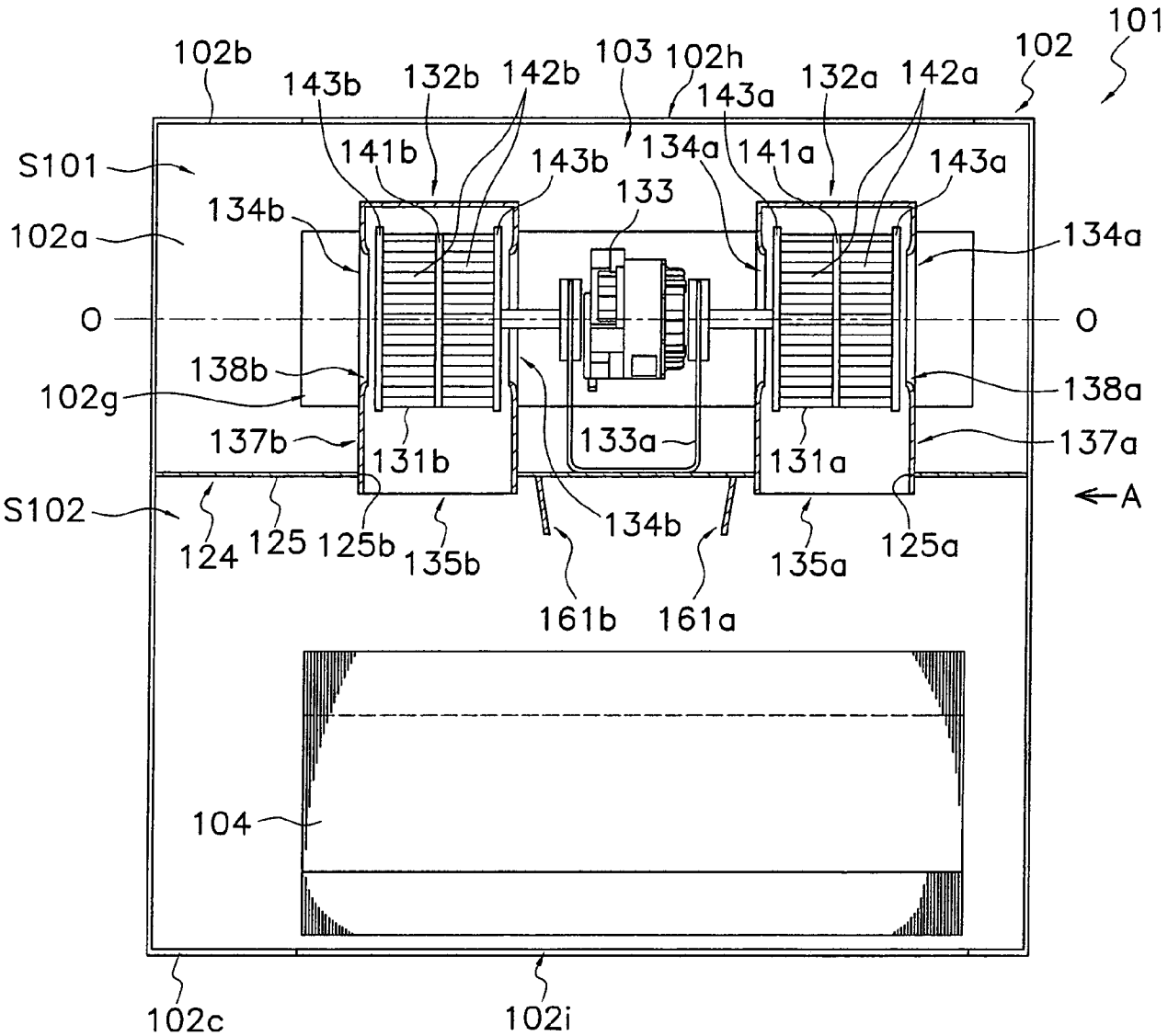
FIG. 11 is a plan sectional view of the duct type air conditioner serving as the second embodiment of the air conditioner pertaining to the present invention.

FIG. 10 and FIG. 11 show a duct type air conditioner 101 serving as a second embodiment of the air conditioner pertaining to the present invention. Here, FIG. 10 is a side view (seen from arrow A in FIG. 11) of the air conditioner O11. FIG. 11 is a plan sectional view of the air conditioner 101. The air conditioner 101 has a duct structure and is disposed in the space behind a ceiling in an air-conditioned room. The air conditioner 101 is connected via refrigerant communication pipes (not shown) to an outdoor unit (not shown) disposed outdoors.

The air conditioner 101 is mainly disposed with a unit casing 102, a centrifugal fan 103, and a heat exchanger 104.

<Unit Casing>

The unit casing 102 is a member shaped like a thin box overall that is long from side to side, with there being formed therein a fan chamber S101, which includes unit suction openings 102*g* and 102*h* in a lower surface 102*a* and in a rear surface 102*b* (the surface at the top of the page in FIG. 11) of the unit casing 102 and in which the centrifugal fan 103 is disposed, and a heat exchanger chamber S102, which includes a unit blowout opening 1021 in a front surface 102*c* (the surface at the bottom of the page in FIG. 11) and in which the heat exchanger 104 is disposed. It will be noted that the unit suction openings 102*g* and 102*h* are configured such that either one can be selected and used in accordance with the installation conditions of the space behind the ceiling. The fan chamber S101 and the heat exchanger chamber S102 are formed as a result of the space inside the unit casing 102 being partitioned front and back by a partition member 124 comprising a plate-like member that is long from side to side and disposed upright inside the unit casing 102. More specifically, in the present embodiment, the partition member 124 includes a flat plate section 125 that runs parallel to the front surface and the rear surface of the unit casing 102 (i.e., orthogonal to the side surfaces of the unit casing 102). Additionally, two communication openings 125*a* and 125*b* that correspond to scroll blowout openings 135*a* and 135*b* (described later) of two scroll casings 132*a* and 132*b* configuring the centrifugal fan 103 and allow the fan chamber S101 and the heat exchanger chamber S102 to be communicated are formed in the flat plate section 125. The two communication openings 125*a* and 125*b* are disposed juxtaposed in the longitudinal direction of the flat plate section 125 and, in the present embodiment, are rectangular holes.

<Centrifugal Fan>

The centrifugal fan 103 is disposed inside the fan chamber S101 and is a device for sucking air into the fan chamber S101 from the unit suction opening 102*g* or the unit suction opening 102*h*, boosting the pressure of the air, and blowing out the air to the heat exchanger chamber S102 through the communication openings 125*a* and 125*b* in the partition member 124. Additionally, the centrifugal fan 103 mainly includes two impellers 131*a* and 131*b*, two scroll casings 132*a* and 132*b* housing the impellers 131*a* and 131*b*, and a motor 133 that drives the impellers 131*a* and 131*b* to rotate.

First, the impellers 131*a* and 131*b* will be described using FIG. 10 and FIG. 11. In the present embodiment, the impellers 131*a* and 131*b* are double suction type sirocco fan rotors and are disposed juxtaposed such that their rotational axis O faces the sides of the unit casing 102 (i.e., along the flat plate section 125 of the partition member 124). It will be noted that, because the impellers 131*a* and 131*b* have the same structure, just the configuration of the impeller 131*a* will be described here, and in regard to the configuration of the impellers 131*b*, the letter b will be added instead of the letter a representing the respective parts of the impeller 131*a* and description of those respective parts will be omitted.

The impeller 131*a* mainly includes a discoid main plate 141*a* that rotates about the rotational axis O, numerous blades 142*a* that are disposed annularly around the rotational axis O on both sides of the outer peripheral portion of the main plate 141*a* with one end of each blade being fixed to the main plate 141*a*, and a pair of side plates 143*a* that are disposed on both sides of the main plate 141*a* in the rotational axis O direction and join together the other ends of the numerous blades 142*a*.

Next, the scroll casings 132*a* and 132*b* will be described. It will be noted that, because the scroll casings 132*a* and 132*b* have the same structure, just the configuration of the scroll casing 132*a* will be described here, and in regard to the configuration of the scroll casing 132*b*, the letter b will be added instead of the letter a representing the respective parts of the scroll casing 132*a* and description of those respective parts will be omitted.

The scroll casing 132*a* includes two scroll suction openings 134*a* formed in both side surfaces in order to configure a double suction type centrifugal fan and a scroll blowout opening 135*a* formed so as to blow out air in the direction intersecting the scroll suction openings 134*a*. Here, the scroll suction openings 134*a* open in the direction of the rotational axis O of the impeller 131*a*. For this reason, the unit suction opening 102*g* and the unit suction opening 102*h* open in the direction intersecting (more specifically, the direction orthogonal to) the opening direction of the scroll suction openings 134*a*. Further, the scroll blowout opening 135*a* is disposed so as to correspond to the communication opening 125*a* in the partition member 124.

More specifically, in the present embodiment, the scroll casing 132*a* is a member made of resin and has a divided structure comprising a scroll lower member 145*a* that covers the impeller 131*a* from below and a scroll upper member 144*a* that covers the impeller 131*a* from above. Additionally, by attaching these members 144*a* and 145*a* to each other, a scroll body section 136*a* that includes the two scroll suction openings 134*a* and houses the impeller 131*a* and a scroll outlet section 137*a* that includes the scroll blowout opening 135*a* and is communicated with the scroll body section 136*a* are configured. Two bellmouth sections 138*a* that surround the scroll suction openings 134*a* are formed in the scroll body section 136*a*. Inner peripheral end portions of the bellmouth sections 138*a* curve in bell shapes toward the impeller 131*a*. The scroll outlet section 137*a* is a member shaped like a square cylinder that is communicated with the portion of the scroll body section 136*a* on the partition member 124 side, and the distal end portion of the scroll outlet section 137*a* is inserted into the communication opening 125*a* formed in the flat plate section 125 of the partition member 124 and projects toward the heat exchanger 104 from the flat plate section 125 of the partition member 124. The scroll outlet section 137*a* extends directly in a direction substantially orthogonal to the flat plate section 125—that is, in a direction orthogonal to the rotational axis O—when the unit casing 102 is seen in plan view and slants somewhat downward so as to blow out air a little downward when the unit casing 102 is seen in side view.

In the present embodiment, the motor 133 is disposed between the scroll casing 132*a* and the scroll casing 132*b* (i.e., on the rotational axis O direction sides of the scroll casing 132*a* and the scroll casing 132*b*) when the unit casing 102 is seen in plan view, and is fixed to the partition member 124 and the unit casing 102 via a support member 133*a*. For this reason, a clearance corresponding to the size of the motor 133 is formed between the scroll casing 132*a* and the scroll casing 132*b*. Additionally, both of the two impellers 131*a* and 131*b* are coupled to the motor 133 so that they can be collectively driven to rotate.

When the centrifugal fan 103 is actuated, air is sucked into the fan chamber S101 of the unit casing 102 via the unit suction opening 102*g* or the unit suction opening 102*h*, and the air that has been sucked into the fan chamber S101 is sucked into the scroll casings 132*a* and 132*b* through the scroll suction openings 134*a* and 134*b* and is blown out from the inner peripheral sides to the outer peripheral sides of the impellers 131*a* and 131*b*. The air that has been blown out to the outer peripheral sides of the impellers 131*a* and 131*b* and whose pressure has been boosted is blown out into the heat exchanger chamber S102 from the scroll blowout openings 135*a* and 135*b* in the scroll casings 132*a* and 132*b* disposed so as to correspond to the communication openings 125*a* and 125*b* in the partition member 124.

<Heat Exchanger>

The heat exchanger 104 is disposed inside the heat exchanger chamber S102 and is a device for cooling or heating the air whose pressure has been boosted by the centrifugal fan 103 inside the fan chamber S101 and which has been blown out into the heat exchanger chamber S102 from the scroll blowout openings 135*a* and 135*b* in the scroll casings 132*a* and 132*b*. In the present embodiment, the heat exchanger 104 is a cross fin tube type heat exchanger and is disposed facing, and parallel to, substantially the entire flat plate section 125 of the partition member 124. For this reason, the heat exchanger 104 is disposed facing the scroll blowout openings 135*a* and 135*b* in the scroll outlet sections 137*a* and 137*b*. Further, the heat exchanger 104 is disposed such that its upper portion slants toward the unit blowout opening 102*i*. Additionally, a drain pan 128 is disposed below the heat exchanger 104 so that condensation water generated by the heat exchanger 104 can be received.

Thus, the air that has been blown out into the heat exchanger chamber S102 from the scroll blowout openings 135*a* and 135*b* is cooled or heated as a result of heat exchange being performed with refrigerant flowing inside a heat transfer tube of the heat exchanger 104 and is blown out into the room from the unit blowout opening 102*i*.

In the air conditioner 101 disposed with the above-described configuration, wall sections 161*a* and 161*b* are further disposed. These wall sections 161*a* and 161*b* will be described below using FIG. 10 to FIG. 12. Here, FIG. 12 is an enlarged view of FIG. 11 and shows the structure of the vicinity of the impeller 131*a* and the scroll casing 132*a*.

<Wall Sections>

Figure 12:
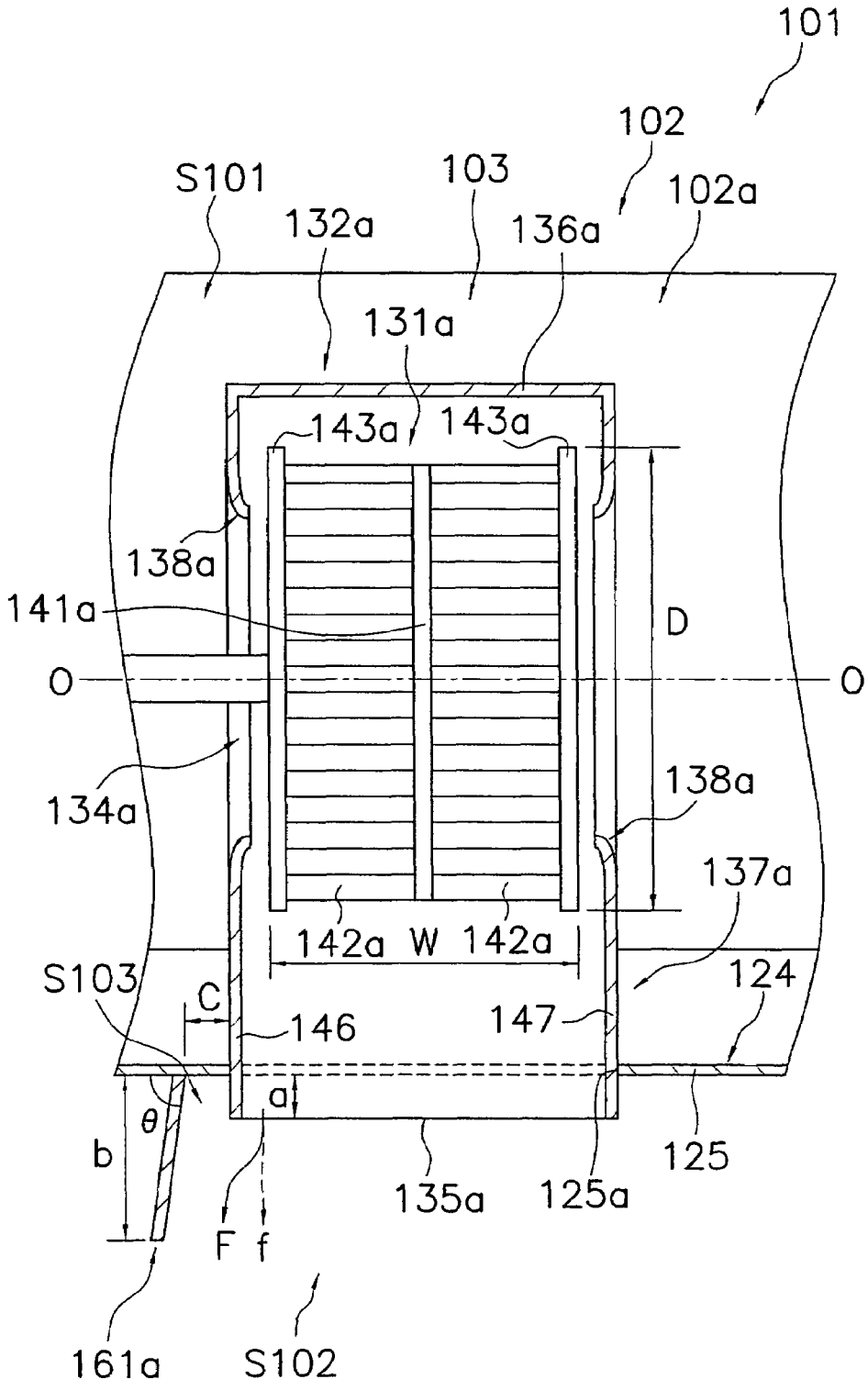
FIG. 12 is an enlarged view of FIG. 11 showing the structure of the vicinity of an impeller and a scroll casing.

As shown in FIG. 11 and FIG. 12, the wall sections 161*a* and 161*b* are portions that project from the heat exchanger 104 side of the flat plate section 125 of the partition member 124 disposed outside the scroll outlet sections 137*a* and 137*b*. It will be noted that, because the wall sections 161*a* and 161*b* have the same structure in the present embodiment, just the configuration of the wall section 161*a* will be described here, and in regard to the configuration of the wall section 161*b*, the letter b will be added instead of the letter a representing the respective parts of the wall section 161*a* and description of those respective parts will be omitted.

In the present embodiment, the wall section 161*a* is disposed to the side of a side wall section 146 of the cylindrical scroll outlet section 137*a*. Additionally, the end portion of the wall section 161*a* on the fan chamber S101 side contacts a position on the flat plate section 125 of the partition member 124 outside the communication opening 125*a* and extends from there so as to project toward the heat exchanger 104.

In the air conditioner 101 of the present embodiment, by disposing the wall section 161*a*, a portion (called negative pressure portion S103 below) whose pressure is lower than the pressure of the air blown out into the heat exchanger chamber S102 from the scroll blowout opening 135*a* is formed in the outside vicinity of the scroll blowout opening 135*a*.

Specifically, the wall section 161*a* is disposed at a position to the side of the side wall section 146 of the scroll outlet section 137*a*—that is, outside the scroll outlet section 137*a* in the rotational axis O direction—so that inside the heat exchanger chamber S102, the negative pressure portion S103 is formed in the outside vicinity of the scroll blowout opening 135*a* in the rotational axis O direction. Moreover, the wall section 161*a* is disposed on the scroll casing 132*b*, which is the adjacent scroll casing, side of the outside of the scroll outlet section 137*a*, so that inside the heat exchanger chamber S102, the negative pressure portion S103 is formed on the scroll casing 132*b* side of the scroll blowout opening 135*a*. Further, the wall section 161*a* is disposed on the motor 133 side of the outside of the scroll outlet section 137*a*, so that inside the heat exchanger chamber S102, the negative pressure portion S103 is formed on the motor 133 side of the scroll blowout opening 135*a*.

Further, in the present embodiment, a distance c between the portion where the scroll outlet section 137*a* and the surface of the flat plate section 125 on the heat exchanger 104 side intersect and the portion where the wall section 161*a* and the surface of the flat plate section 125 on the heat exchanger 104 side intersect is equal to or less than 0.5 times a rotor width W of the impeller 131*a*. More specifically, a distance c between the portion where the outer surface of the side surface portion 146 of the scroll outlet section 137*a* (i.e., the surface on the side of the wall section 161*a*) and the surface of the flat plate section 125 on the heat exchanger 104 side intersect and the portion where the inner surface of the wall section 161*a* (i.e., the surface on the side of the side surface portion 146 of the scroll outlet section 137*a*) and the surface of the flat plate section 125 on the heat exchanger 104 side intersect is equal to or less than 0.5 times the rotor width W of the impeller 131*a*. In the air conditioner 101 of the present embodiment, by making the distance c equal to or less than 0.5 times the rotor width W, the negative pressure portion S103 can be reliably formed in the outside vicinity of the scroll blowout opening 135*a*. It will be noted that when the wall section 161*a* does not contact the flat plate section 125, the portion where the wall section 161*a* and the surface of the flat plate section 125 on the heat exchanger 104 side would intersect if the end portion of the wall section 161*a* on the flat plate section 125 side were to be extended corresponds to the portion where the wall section 161*a* and the surface of the flat plate section 125 on the heat exchanger 104 side intersect.

Further, in the present embodiment, a distance a from the surface of the flat plate section 125 on the heat exchanger 104 side to the end portion of the scroll outlet section 137*a* on the heat exchanger 104 side is greater than 0 and equal to or less than 0.3 times a rotor diameter D of the impeller 131*a*. More specifically, a distance a from the surface of the flat plate section 125 on the heat exchanger 104 side to the end portion of the side surface portion 146 of the scroll outlet section 137*a* on the heat exchanger 104 side is greater than 0 and equal to or less than 0.3 times the rotor diameter D of the impeller 131*a*. In the air conditioner 101 of the present embodiment, by making the distance a greater than 0—that is, by allowing the end portion of the scroll outlet section 137*a* on the heat exchanger 104 side to project toward the heat exchanger chamber S102—the negative pressure portion S103 comprising space interposed between the wall section 161*a* and the end portion of the scroll outlet section 137*a* on the heat exchanger 104 side can be formed in the outside vicinity of the scroll blowout opening 135*a*.

Further, in the present embodiment, a distance b from the surface of the flat plate section 125 on the heat exchanger 104 side to the end portion of the wall section 161*a* on the heat exchanger 104 side is equal to or greater than the distance a and equal to or less than 0.5 times the rotor diameter D of the impeller 131*a*. More specifically, a distance b from the surface of the flat plate section 125 on the heat exchanger 104 side to the end portion of the wall section 161*a* on the heat exchanger 104 side is equal to or greater than the distance a and equal to or less than 0.5 times the rotor diameter D of the impeller 131*a*. In the air conditioner 101 of the present embodiment, by making the distance b equal to or greater than the distance a—that is, by allowing the end portion of the wall section 161*a* to project further toward the heat exchanger 104 than the end portion of the scroll outlet section 137*a* on the heat exchanger 104 side—the difference in pressure between the pressure of the negative pressure portion S103 comprising space interposed between the wall section 161*a* and the end portion of the scroll outlet section 137*a* on the heat exchanger 104 side and the pressure of the air blown out into the heat exchanger chamber S102 from the scroll blowout opening 135*a* can be made greater.

Further, in the present embodiment, an angle θ formed by the wall section 161*a* and the surface of the flat plate section 125 on the heat exchanger 104 side is greater than 30° and equal to or less than 90°. More specifically, the angle θ formed by the inner surface of the wall section 161*a* (i.e., the surface on the side of the side surface portion 146 of the scroll outlet section 137*a*) and the portion of the surface of the flat plate 125 on the heat exchanger 104 side outside the wall section 161*a* is greater than 30° and equal to or less than 90°. In the air conditioner 101 of the present embodiment, by making the angle formed by the wall section 161*a* and the surface of the flat plate section 125 on the heat exchanger 104 side greater than 30°, the negative pressure portion S103 can be reliably formed in the outside vicinity of the scroll blowout opening 135*a*. Moreover, by making the angle formed by the wall section 161*a* and the surface of the flat plate section 125 on the heat exchanger 104 side equal to or less than 90°, it can be ensured that the air blown out into the heat exchanger chamber S102 from the scroll blowout opening 135*a* is reliably diffused to the outside of the scroll blowout opening 135*a*.

(2) Operation of Air Conditioner

Next, operation of the air conditioner 101 of the present embodiment will be described using FIG. 10 to FIG. 12.

When the motor 133 is started to actuate the centrifugal fan 103, air is sucked into the fan chamber S101 of the unit casing 102 via the unit suction opening 102*g* or the unit suction opening 102*h*, and the air that has been sucked into the fan chamber S101 is sucked into the scroll casings 132*a* and 132*b* through the scroll suction openings 134*a* and 134*b* and is blown out from the inner peripheral sides to the outer peripheral sides of the impellers 131*a* and 131*b*. The air that has been blown out to the outer peripheral sides of the impellers 131*a* and 131*b* and whose pressure has been boosted is blown out into the heat exchanger chamber S102 from the scroll blowout openings 135*a* and 135*b* disposed so as to correspond to the communication openings 125*a* and 125*b* in the partition member 124. Then, the air that has been blown out into the heat exchanger chamber S102 from the scroll blowout openings 135*a* and 135*b* is cooled or heated as a result of heat exchange being performed with refrigerant flowing inside the heat transfer tube of the heat exchanger 104 and is blown out into the room from the unit blowout opening 1021.

Here, in the air conditioner 101 of the present embodiment, the wall sections 161*a* and 161*b* that project from the heat exchanger 104 side of the flat plate section 125 are disposed outside the scroll outlet sections 137*a* and 137*b*, so that the negative pressure portions S103 whose pressure is lower than the pressure of the air blown out into the heat exchanger chamber S102 from the scroll blowout openings 135*a* and 135*b* are formed in the outside vicinities of the scroll blowout openings 135*a* and 135*b*. Additionally, the air blown out into the heat exchanger chamber S102 from the scroll blowout openings 135*a* and 135*b* (see arrow F in FIG. 12) flows so as to be pulled into the negative pressure portions S103, so that the air is more diffused to the outsides of the scroll blowout openings 135*a* and 135*b* in comparison to when wall sections are not disposed in the scroll outlet sections (see arrow f showing the flow of air when wall sections are not disposed in the scroll outlet sections). Specifically, the wall sections 161*a* and 161*b* are disposed outside the scroll outlet sections 137*a* and 137*b* in the rotational axis O direction, so that inside the heat exchanger chamber S102, the negative pressure portions S103 are formed in the outside vicinities of the scroll blowout openings 135*a* and 135*b* in the rotational axis O direction. For this reason, when the impellers 131*a* and 131*b* are disposed so as to rotate about the rotational axis O along the flat plate section 125 of the partition member 124 as in the air conditioner 101 of the present embodiment, there is a strong tendency for it to be difficult for the air blown out to the heat exchanger chamber S102 from the scroll outlet sections 137*a* and 137*b* opening in the direction intersecting the rotational axis O to be diffused in the direction along the rotational axis O, but because the negative pressure portions S103 are formed, the air blown out into the heat exchanger chamber S102 from the scroll blowout openings 135*a* and 135*b* flows so as to be pulled into the negative pressure portions S103, so that it becomes easier for the air to be diffused to the outsides of the scroll blowout openings 135*a* and 135*b* in the rotational axis O direction. Thus, nonuniformity in the flow of air passing through the heat exchanger 104 can be controlled while controlling a reduction in blowing capability.

Moreover, the wall section 161*a* is disposed on the scroll casing 132*b*, which is the adjacent scroll casing, side of the outside of the scroll outlet section 137*a* and the wall section 161*b* is disposed on the scroll casing 132*a*, which is the adjacent scroll casing, side of the outside of the scroll outlet section 137*b*, so that inside the heat exchanger chamber S102, the negative pressure portions S103 are formed on the scroll casing 132*b* side of the scroll blowout opening 135*a* and on the scroll casing 132*a* side of the scroll blowout opening 135*b*. For this reason, when the impellers 131*a* and 131*b* are disposed so as to rotate about the rotational axis O along the flat plate section 125 of the partition member 124 and the impellers 131*a* and 131*b* and the scroll casings 132*a* and 132*b* are disposed plurally juxtaposed in the rotational axis O direction as in the air conditioner 101 of the present embodiment, a clearance is formed between the mutually adjacent scroll casing 132*a* and scroll casing 132*b* in the rotational axis O direction, and it becomes difficult for the air that has been blown out the heat exchanger chamber S102 from the scroll outlet sections 137*a* and 137*b* to pass through the portion corresponding to this clearance, but because the negative pressure portions S103 are formed, the air blown out into the heat exchanger chamber S102 from the scroll blowout openings 135*a* and 135*b* flows so as to be pulled into the negative pressure portions S103, so that it becomes easier for the air to be diffused toward the scroll casing 132*b* side of the scroll blowout opening 135*a* and toward the scroll casing 132*a* side of the scroll blowout opening 135*b*. Thus, nonuniformity in the flow of air passing through the heat exchanger 104 can be controlled while controlling a reduction in blowing capability.

Further, the wall section 161*a* is disposed on the motor 133 side of the outside of the scroll outlet section 137*a* and the wall section 161*b* is disposed on the motor 133 side of the outside of the scroll outlet section 137*b*, so that inside the heat exchanger chamber S102, the negative pressure portions S103 are formed on the motor 133 side of the scroll blowout opening 135*a* and on the motor 133 side of the scroll blowout opening 135*b*. For this reason, when the motor 133 that drives the impellers 131*a* and 131*b* to rotate is disposed on the rotational axis O direction sides of the scroll casings 132*a* and 132*b* as in the air conditioner 101 of the present embodiment, the air that has been blown out into the heat exchanger chamber S102 from the scroll blowout openings 135*a* and 135*b* ends up mainly passing through the portions of the heat exchanger 104 facing the scroll casings 132*a* and 132*b* with the flat plate section 124 interposed therebetween and it becomes difficult for the air to pass through the portion of the heat exchanger 104 facing the motor 133 with the flat plate section 124 interposed therebetween, but because the negative pressure portions S103 are formed, the air blown out into the heat exchanger chamber S102 from the scroll blowout openings 135*a* and 135*b* flows so as to be pulled into the negative pressure portions S103, so that it becomes easier for the air to be diffused toward the motor 133 side of the scroll blowout openings 135*a* and 135*b*. Thus, nonuniformity in the flow of air passing through the heat exchanger 104 can be controlled while controlling a reduction in blowing capability.

Further, in the air conditioner 101 of the present embodiment, by making the distance c equal to or less than 0.5 times the rotor width W of the impellers 131*a* and 131*b*, the negative pressure portions S103 can be reliably formed in the outside vicinities of the scroll blowout openings 135*a* and 135*b*.

Further, in the air conditioner 101 of the present embodiment, by making the distance a greater than 0—that is, by allowing the end portions of the scroll outlet sections 137*a* and 137*b* on the heat exchanger 104 side to project toward the heat exchanger chamber S102—the negative pressure portions S103 comprising spaces interposed between the wall sections 161*a* and 161*b* and the end portions of the scroll outlet sections 137*a* and 137*b* on the heat exchanger 104 side can be formed in the outside vicinities of the scroll blowout openings 135*a* and 135*b* where the effect of causing the air blown out into the heat exchanger chamber S102 from the scroll blowout openings 135*a* and 135*b* to be diffused outside the scroll blowout openings 135*a* and 135*b* is large. Moreover, by making the distance a equal to or less than 0.3 times the rotor diameter D of the impellers 131*a* and 131*b*, a distance that is sufficient for the air blown out into the heat exchanger chamber S102 from the scroll blowout openings 135*a* and 135*b* to diffuse outside the scroll blowout openings 135*a* and 135*b* can be ensured between the scroll blowout openings 135*a* and 135*b* and the heat exchanger 104.

Further, in the air conditioner 101 of the present embodiment, by making the distance b equal to or greater than the distance a—that is, by allowing the end portions of the wall sections 161*a* and 161*b* to project further toward the heat exchanger 104 than the end portions of the scroll outlet sections 137*a* and 137*b* on the heat exchanger 104 side—the difference in pressure between the pressure of the negative pressure portions S103 comprising spaces interposed between the wall sections 161*a* and 161*b* and the end portions of the scroll outlet sections 137*a* and 137*b* on the heat exchanger 104 side and the pressure of the air blown out into the heat exchanger chamber S102 from the scroll blowout openings 1135*a* and 135*b* can be made greater, so that the effect of causing the air blown out into the heat exchanger chamber S102 from the scroll blowout openings 135*a* and 135*b* to be diffused to the outsides of the scroll blowout openings 135*a* and 135*b* can be raised. Moreover, by making the distance b equal to or less than 0.5 times the rotor diameter D of the impellers 131*a* and 131*b*, it can be ensured that the flow of air to be diffused by the negative pressure portions S103 to the outsides of the scroll blowout openings 135*a* and 135*b* is, as much as possible, not restricted by the wall sections 161*a* and 161*b*, so that the air blown out into the heat exchanger chamber S102 from the scroll blowout openings 135*a* and 135*b* can be further diffused outside the wall sections 161*a* and 161*b*.

Further, in the air conditioner 101 of the present embodiment, by making the angle θ greater than 30°, the negative pressure portions S103 can be reliably formed in the outside vicinities of the scroll blowout openings 135*a* and 135*b*. Moreover, by making the angle θ equal to or less than 90°, it can be ensured that the air blown out into the heat exchanger chamber S102 from the scroll blowout openings 135*a* and 135*b* is reliably diffused outside of the scroll blowout openings 135*a* and 135*b*.

In this manner, in the air conditioner 101 of the present embodiment, whereas the heat exchanger 104 faces substantially the entire flat plate section 125 of the partition member 124, the communication openings 125*a* and 125*b* in the flat plate section 125—that is, the scroll blowout openings 135*a* and 135*b* in the scroll casings 132*a* and 132*b*—are only disposed partially in the flat plate section 125 of the partition member 124, but by disposing the wall sections 161*a* and 161*b*, the air blown out into the heat exchanger chamber S102 from the scroll blowout openings 135*a* and 135*b* can be diffused outside the scroll blowout openings 135*a* and 135*b*—and particularly outside in the rotational axis O direction—and allowed to pass through the heat exchanger 104 without having to increase the size of the scroll blowout openings 135*a* and 135*b*, and nonuniformity in the flow of air passing through the heat exchanger 104 can be controlled.

Moreover, because the wall sections 161*a* and 161*b* are disposed on the heat exchanger chamber S102 side of the flat plate section 125 of the partition member 124, problems do not arise where the wall sections 161*a* and 161*b* hinder the scroll suction openings 134*a* and 134*b* such that dynamic pressure recovery in the scroll outlet sections 137*a* and 137*b* becomes difficult, and the wall sections 161*a* and 161*b* are effective as means to control nonuniformity in the flow of air passing through the heat exchanger 104 when there is no extra space inside the fan chamber S101 or when the unit casing 102 must be made compact.

(3) Modification 1

Figure 13:
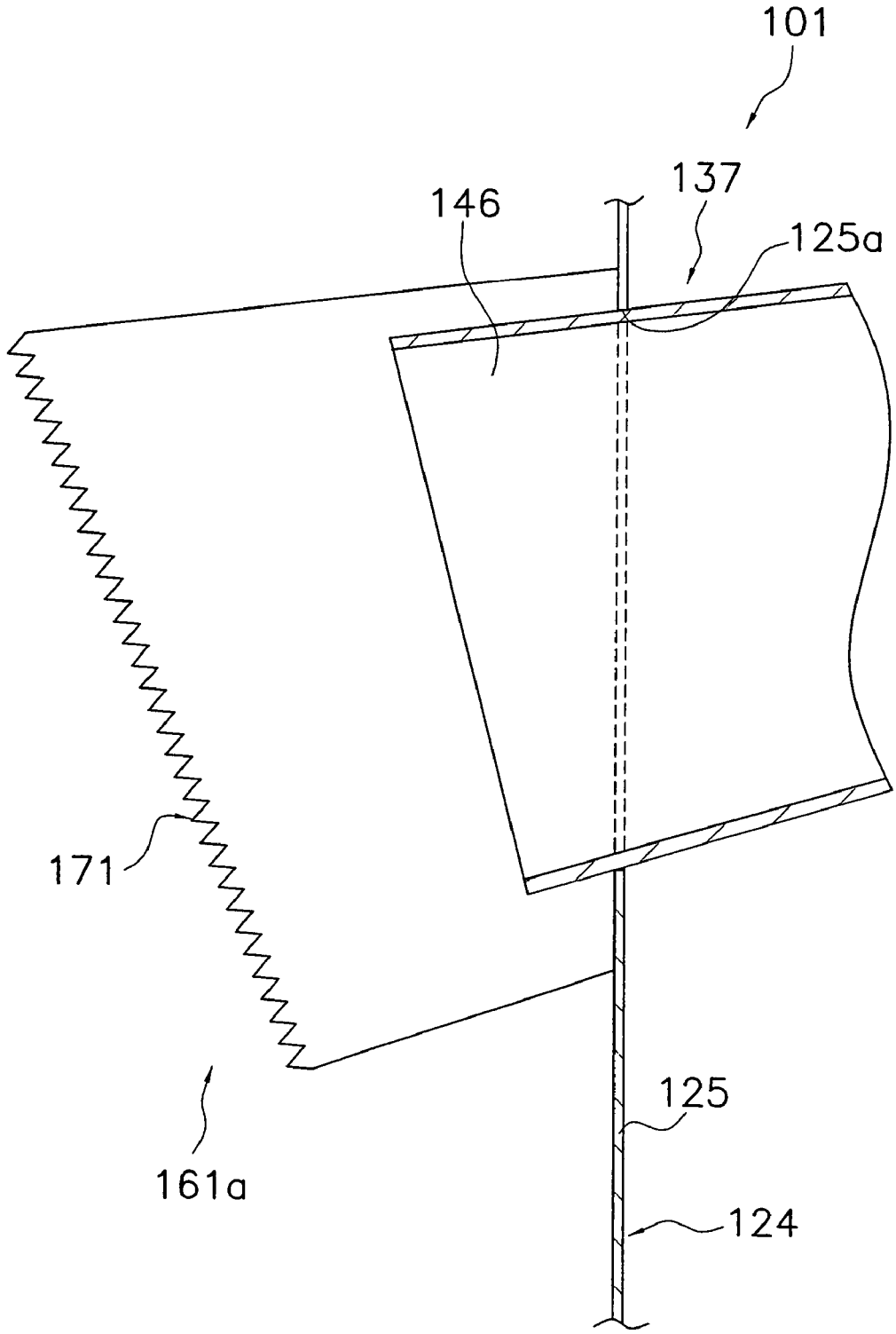
FIG. 13 is a view showing the structure of the vicinity of a scroll outlet section in an air conditioner pertaining to a first modification of the second embodiment.

In the air conditioner 101 of the present embodiment also, similar to modification 1 of the air conditioner 1 of the first embodiment, serrations may be disposed in the end portions of the wall sections 161*a* and 161*b* on the heat exchanger 104 side (see FIG. 13). Thus, variations in the pressure of the air blown out into the heat exchanger chamber S102 from the scroll blowout openings 135*a* and 135*b* at the end portions of the wall sections 161*a* and 161*b* on the heat exchanger 104 side can be controlled, and the occurrence of noise resulting from pressure variations at the end portions of the wall sections 161*a* and 161*b* on the heat exchanger 104 side can be controlled.

Figure 14:
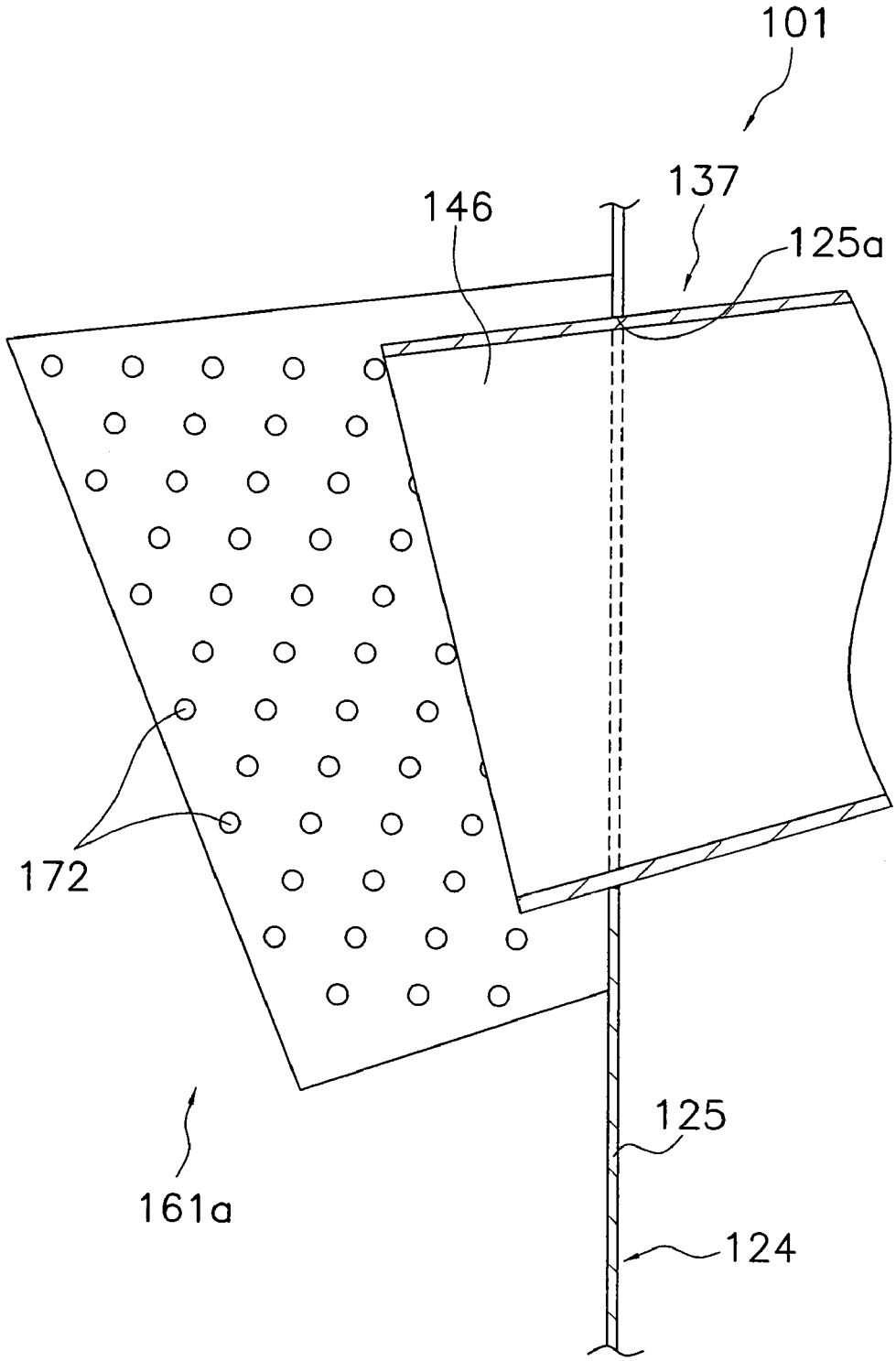
FIG. 14 is a view showing the structure of the vicinity of the scroll outlet section in the air conditioner pertaining to the first modification of the second embodiment.
Figure 15:
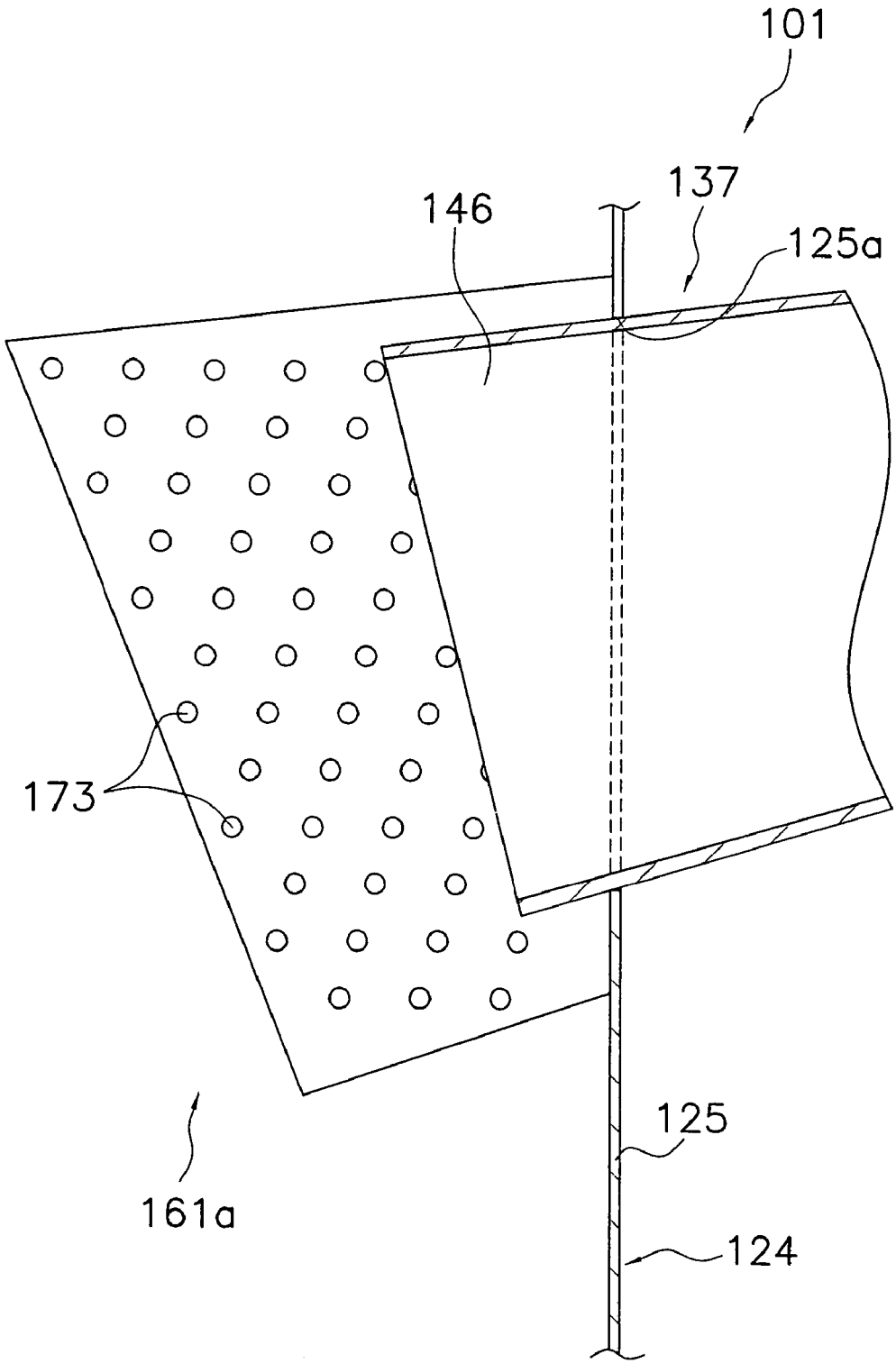
FIG. 15 is a view showing the structure of the vicinity of the scroll outlet section in the air conditioner pertaining to the first modification of the second embodiment.

Further, in the air conditioner 101 of the present embodiment also, similar to modification 2 of the air conditioner 1 of the first embodiment, plural dimples (see FIG. 14) or plural through holes 173 (see FIG. 15) may be disposed in the inner surfaces of the wall sections 161*a* and 161*b*. Thus, the air blown out into the heat exchanger chamber S102 from the scroll blowout openings 135*a* and 135*b* can be matched to the surfaces of the wall sections 161*a* and 161*b* on the sides of the scroll outlet sections 137*a* and 137*b*, and the effect of causing the air blown out into the heat exchanger chamber S102 from the scroll blowout openings 135*a* and 135*b* to be diffused to the outsides of the scroll blowout openings 135*a* and 135*b* can be raised.

Figure 16:
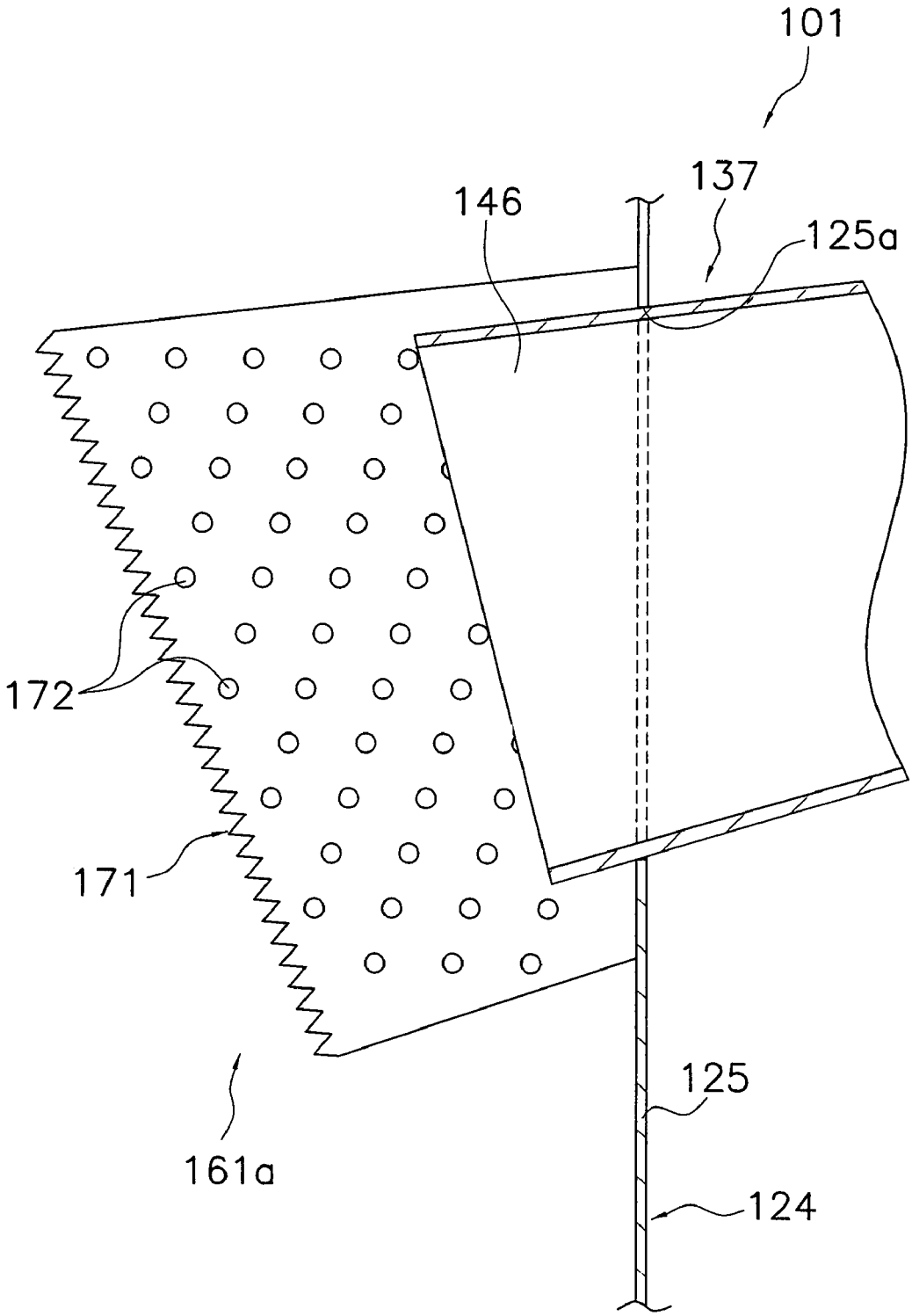
FIG. 16 is a view showing the structure of the vicinity of the scroll outlet section in the air conditioner pertaining to the first modification of the second embodiment.

Moreover, in the air conditioner 101 of the present embodiment also, similar to modification 3 of the air conditioner 1 of the first embodiment, serrations 171 and plural dimples 172 or the through holes 173 may be simultaneously disposed in the wall sections 161*a* and 161*b* (see FIG. 16, which shows an example where the serrations 171 and the dimples 172 are disposed). Thus, the effect of disposing serrations and the effect of disposing plural dimples or through holes can be simultaneously obtained.

(2) Modification 2

Figure 17:
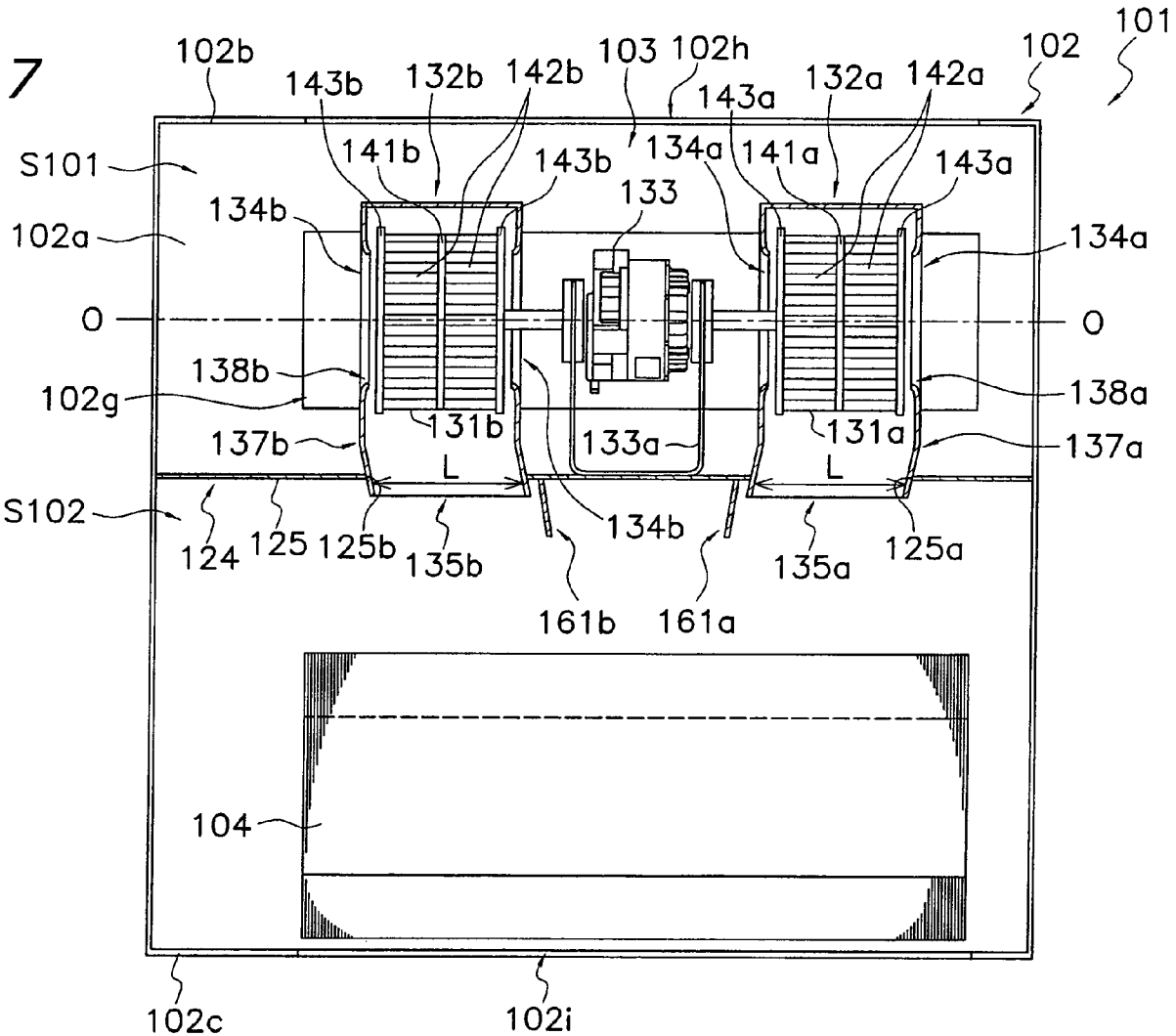
FIG. 17 is a view corresponding to FIG. 11 and showing an air conditioner pertaining to a second modification of the second embodiment.

Further, in the air conditioner 101 of the second embodiment (including modification 1) also, similar to modification 4 of the air conditioner 1 of the first embodiment, the scroll outlet sections 137*a* and 137*b* of the scroll casings 132*a* and 132*b* may be formed so as to extend toward the communication openings 125*a* and 125*b* while slanting toward the motor 133 but without their size L in the rotational axis O direction being enlarged (see FIG. 17). Thus, it becomes easier for the air that has been blown out into the heat exchanger chamber S102 to pass through the portion of the heat exchanger 104 facing the motor 133 with the flat plate section 125 interposed therebetween, and nonuniformity in the flow of air passing through the heat exchanger 104 can be controlled. Moreover, because it is ensured that the size L of the scroll outlet sections 137*a* and 137*b* in the rotational axis O direction is not enlarged, it also becomes difficult for drawbacks such as dynamic pressure recovery in the scroll outlet sections 137*a* and 137*b* becoming difficult to occur, and a reduction in blowing performance can be controlled.

Other Embodiments

Embodiments of the present invention have been described on the basis of the drawings, but the specific configuration thereof is not limited to these embodiments and may be altered in a range that does not depart from the gist of the invention.

For example, in the first embodiment, an example was described where the present invention was applied to a ceiling-hung type air conditioner, and in the second embodiment, an example was described where the present invention was applied to a duct type air conditioner, but the present invention is not limited thereto and may also be applied to a ceiling-embedded type air conditioner that is disposed with a unit casing partitioned by a partition member into a fan chamber and a heat exchanger chamber, with a centrifugal fan including an impeller and a scroll casing housing the impeller being disposed inside the fan chamber and a heat exchanger being disposed inside the heat exchanger chamber facing a scroll blowout opening in the scroll casing.

INDUSTRIAL APPLICABILITY

By utilizing the present invention, nonuniformity in the flow of air passing through a heat exchanger can be controlled while controlling a reduction in blowing capability in an air conditioner disposed with a unit casing partitioned by a partition member into a fan chamber and a heat exchanger chamber, with a centrifugal fan that includes an impeller and a scroll casing housing the impeller being disposed inside the fan chamber and a heat exchanger being disposed inside the heat exchanger chamber so as to face a scroll blowout opening in the scroll casing.

What is claimed is:

1. An air conditioner comprising:

a unit casing including a unit suction opening and a unit blowout opening;

a partition member partitioning the unit casing into a fan chamber communicating with the unit suction opening and a heat exchanger chamber communicating with the unit blowout opening, the partition member including a flat plate section having a communication opening being formed therein, the communication opening allowing the fan chamber and the heat exchanger chamber to communicate;

an impeller being disposed in the fan chamber;

a scroll casing including a scroll body section having a scroll suction opening, the scroll casing housing the impeller and a cylindrical scroll outlet section, the scroll outlet section having a scroll blowout opening disposed in correspondence to the communication opening;

a heat exchanger being disposed inside the heat exchanger chamber so as to face the scroll blowout opening such that air that has been blown out into the heat exchanger chamber from the scroll blowout opening is blown out from the unit blowout opening after passing through the heat exchanger; and a wall section projecting from the heat exchanger side of the flat plate section of the partition member, the wall section being disposed on the outer circumference side of the communication opening and intersecting the heat exchanger side of the flat plate section of the partition member when the scroll outlet section and the flat plate section are seen from a direction facing the scroll blowout opening, an intersection of the communication opening side of the wall section and the heat exchanger side of the flat plate section being arranged at a predetermined distance from the circumference edge of the communication opening, the predetermined distance being greater than zero.

2. The air conditioner of claim 1, wherein the predetermined distance is greater than zero and equal to or less than 0.5 times a rotor width of the impeller.

3. The air conditioner of claim 1, wherein a distance from the surface of the flat plate section on the heat exchanger side to an end portion of the scroll outlet section on the heat exchanger side is greater than 0 and equal to or less than 0.3 times a rotor diameter of the impeller.

4. The air conditioner of claim 3, wherein a distance from the surface of the flat plate section on the heat exchanger side to an end portion of the wall section on the heat exchanger side is equal to or greater than the distance from the surface of the flat plate section on the heat exchanger side to the end portion of the scroll outlet section on the heat exchanger side and is equal to or less than 0.5 times the rotor diameter of the impeller.

5. The air conditioner of claim 1, wherein an angle formed by the wall section and the surface of the flat plate section on the heat exchanger side is greater than 30° and equal to or less than 90°.

6. The air conditioner of claim 1, wherein serrations are disposed in the end portion of the wall section on the heat exchanger chamber side.

7. The air conditioner of claim 1, wherein a plurality of dimples are disposed in the surface of the wall section on the side of the scroll outlet section.

8. The air conditioner of claim 1, wherein plural through holes are disposed in the wall section.

9. The air conditioner of claim 1, wherein the impeller is disposed so as to rotate about a rotational axis along the flat plate section, the air conditioner further comprises a motor that is disposed on the rotational axis direction side of the scroll casing inside the fan chamber and which drives the impeller to rotate, and the scroll outlet section extends toward the communication opening while slanting toward the motor but without its size in the rotational axis direction being enlarged.

10. The air conditioner of claim 1, wherein the impeller is disposed so as to rotate about a rotational axis along the flat plate section, and the wall section is disposed outside the scroll outlet section in the rotational axis direction.

11. The air conditioner of claim 10, wherein the impellers and the scroll casings are disposed plurally juxtaposed in the rotational axis direction, and the wall sections are disposed on adjacent scroll casing sides of the outside of the scroll outlet sections.

12. The air conditioner of claim 10, further comprising a motor disposed on the rotational axis direction side of the scroll casing inside the fan chamber and which drives the impeller to rotate, wherein the wall section is disposed on a motor side of the outside of the scroll outlet section.

13. The air conditioner of claim 12, wherein the scroll outlet section extends toward the communication opening while slanting toward the motor but without its size in the rotational axis direction being enlarged.

14. The air conditioner of claim 2, wherein the impeller is disposed so as to rotate about a rotational axis along the flat plate section, the air conditioner further comprises a motor that is disposed on the rotational axis direction side of the scroll casing inside the fan chamber and which drives the impeller to rotate, and the scroll outlet section extends toward the communication opening while slanting toward the motor but without its size in the rotational axis direction being enlarged.

15. The air conditioner of claim 2, wherein the impeller is disposed so as to rotate about a rotational axis along the flat plate section, and the wall section is disposed outside the scroll outlet section in the rotational axis direction.

16. The air conditioner of claim 3, wherein the impeller is disposed so as to rotate about a rotational axis along the flat plate section, the air conditioner further comprises a motor that is disposed on the rotational axis direction side of the scroll casing inside the fan chamber and which drives the impeller to rotate, and the scroll outlet section extends toward the communication opening while slanting toward the motor but without its size in the rotational axis direction being enlarged.

17. The air conditioner of claim 3, wherein the impeller is disposed so as to rotate about a rotational axis along the flat plate section, and the wall section is disposed outside the scroll outlet section in the rotational axis direction.

18. The air conditioner of claim 4, wherein the impeller is disposed so as to rotate about a rotational axis along the flat plate section, the air conditioner further comprises a motor that is disposed on the rotational axis direction side of the scroll casing inside the fan chamber and which drives the impeller to rotate, and the scroll outlet section extends toward the communication opening while slanting toward the motor but without its size in the rotational axis direction being enlarged.

19. The air conditioner of claim 4, wherein the impeller is disposed so as to rotate about a rotational axis along the flat plate section, and the wall section is disposed outside the scroll outlet section in the rotational axis direction.

20. The air conditioner of claim 1, wherein the scroll outlet section extends from the fan chamber through the communication opening into the heat exchanger chamber a second predetermined distance from a heat exchanger chamber side of the partition member, the second predetermined distance is greater than zero.

* * * * *